US008873994B2

(12) United States Patent
Nakazawa et al.

(10) Patent No.: US 8,873,994 B2
(45) Date of Patent: Oct. 28, 2014

(54) IMAGE FORMING APPARATUS

(75) Inventors: Shinji Nakazawa, Osaka (JP); Shinichi Takeda, Osaka (JP); Norio Tomita, Osaka (JP); Kohichi Yamauchi, Osaka (JP); Noriaki Taguchi, Osaka (JP); Yoshiteru Kikuchi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 192 days.

(21) Appl. No.: 13/099,466

(22) Filed: May 3, 2011

(65) Prior Publication Data

US 2011/0280609 A1 Nov. 17, 2011

(30) Foreign Application Priority Data

May 11, 2010 (JP) ..... 2010-109492

(51) Int. Cl.
*G03G 21/20* (2006.01)

(52) U.S. Cl.
CPC ..... *G03G 21/206* (2013.01); *G03G 2221/1645* (2013.01)
USPC ..... 399/92

(58) Field of Classification Search
CPC ..... G03G 21/206; G03G 2221/1645
USPC ..... 399/92, 93, 94
See application file for complete search history.

(56) References Cited

U.S. PATENT DOCUMENTS

| | | | | |
|---|---|---|---|---|
| 5,315,350 | A * | 5/1994 | Hirobe et al. | 399/69 |
| 2001/0051059 | A1* | 12/2001 | Morikami et al. | 399/121 |
| 2006/0275048 | A1* | 12/2006 | Nishimura et al. | 399/92 |
| 2007/0146739 | A1* | 6/2007 | Igarashi | 358/1.7 |
| 2009/0123173 | A1 | 5/2009 | Kadowaki | |
| 2009/0285588 | A1* | 11/2009 | Furuichi et al. | 399/27 |

FOREIGN PATENT DOCUMENTS

| | | |
|---|---|---|
| JP | 09-222760 | 8/1997 |
| JP | 2008-076777 | 4/2008 |
| JP | 2009-122221 | 6/2009 |
| JP | 2009-258444 | 11/2009 |
| JP | 2009-288472 | 12/2009 |

* cited by examiner

*Primary Examiner* — David Gray
*Assistant Examiner* — Thomas Giampaolo, II
(74) *Attorney, Agent, or Firm* — Renner, Otto, Boisselle & Sklar, LLP

(57) ABSTRACT

In one embodiment, an image forming apparatus (100) is provided with a resin frame (300) made of resin and an image forming unit (200). The image forming apparatus further includes a first duct (410) that allows air to flow on one side of the image forming unit (200), a second duct (420) that allows air to flow on the other side, and a third duct (430) that allows air to flow between the first duct and the second duct. The resin frame (300) has a first duct portion (311) that constitutes at least a portion of the first duct (410), and a second duct portion (321) that constitutes at least a portion of the second duct (420).

12 Claims, 20 Drawing Sheets

IMAGE FORMING APPARATUS

CROSS-REFERENCE TO RELATED APPLICATION

This application claims priority under 35 U.S.C. §119(a) on Patent Application No. 2010-109492 filed in Japan on May 11, 2010, the entire contents of which are herein incorporated by reference.

BACKGROUND OF THE INVENTION

The present invention relates to an image forming apparatus provided with a resin frame made of resin and image forming units.

A frame that constitutes the basic structure of an image forming apparatus such as a copying machine, a printer, a facsimile machine or a digital multifunction machine is conventionally a metal frame structure made by assembling pressed metal parts or metal based steel materials by joining or welding.

In a recent trend of reducing the production cost of image forming apparatuses, those produced with conventional metal frames are not sufficiently profitable. Moreover, there is a great demand for compactness and lightness of weight, which requires simplicity of structures and reduction of the number of parts. However, there is a limit in compactness and lightness of metal frame structures.

Resin frames made of resin may be adopted in view of cost reduction, compactness and lightness of weight required for frame structures, but in this case there may be problems in terms of strength.

For an image forming apparatus provided with image forming units (process units) including a photosensitive unit, a charging unit and a development unit, ducts may be provided for the purpose of exhausting unwanted substances such as ozone or nitrogen oxides (NOx) generated by a charger that charges a photosensitive member to a predetermined potential, or cooling the image forming units.

For example, JP 2009-122221A (Patent Document 1) discloses an image forming apparatus that can exhaust ozone without increasing the size of the apparatus by providing a duct member for allowing air to flow on the removable side of the image forming units integrally with a positioning member for a photosensitive member that positions the rotation axis of the photosensitive member, and allowing air near a charger to flow in from an opening portion provided between the positioning member for the photosensitive member and the duct member into the duct by means of a fan that generates air flow.

However, in the image forming apparatuses disclosed in Patent Document 1, the duct member allows air to flow only on the removable side of the image forming units, and air cannot reliably flow in the image forming units, and thus unwanted substances cannot be exhausted reliably or the image forming units cannot be cooled reliably. Furthermore, although Patent Document 1 does not disclose that the frame is made of metal or resin, if the frame of the image forming apparatus of Patent Document 1 is made of resin, the duct member cannot contribute to reinforcement of the frame, which does not provide any solution to the strength problem.

SUMMARY OF THE INVENTION

Therefore, it is an object of the present invention to provide an image forming apparatus provided with a resin frame made of resin, an image forming unit, in which air can flow reliably to the image forming unit, and therefore unwanted substances can be exhausted reliably and the image forming unit can be cooled reliably, and also the strength of the resin frame can be improved.

In order to solve the above problems, the present invention provides an image forming apparatus including a resin frame made of resin and an image forming unit includes a first duct that allows air to flow on one side of the image forming unit, a second duct that allows air to flow on the other side that is opposite to the one side, and a third duct that allows air to flow between the first duct and the second duct. The resin frame has a first duct portion that constitutes at least a portion of the first duct, and a second duct portion that constitutes at least a portion of the second duct.

According to the present invention, the image forming apparatus is provided with the first duct for allowing air to flow on one side of the image forming apparatus, the second duct for allowing air to flow on the other side that is opposite side to the removable side, and the third duct for allowing air to flow between the first duct and the second duct Therefore, air can flow not only in the first duct on the removable side, but also in the third duct and further the second duct on the opposite side. For this reason, air can flow reliably to the image forming unit, and therefore unwanted substances such as ozone or nitrogen oxides (NOx) can be exhausted reliably from the image forming unit, and the image forming unit can be cooled reliably. In addition, the resin frame has the first duct portion constituting at least a portion of the first duct, and the second duct portion constituting at least a portion of the second duct, and therefore the strength of the resin frame can be improved.

Herein, an embodiment in which the image forming units include photosensitive units, charging units, cleaning units and development units can be shown as example. The image forming units may be units in which at least two of the photosensitive units, the charging units, the cleaning units and the development units are combined. In this case, the at least two units may be an integral unit.

In the present invention, an embodiment in which the one side is a removable side of the image forming unit, and the other side is an opposite side to the removable side of the image forming unit may be possible.

With this feature, the first duct allows air to flow on the removable side (user operation side) of the image forming unit, the second duct allows air to flow on the opposite side to the removable side, and the third duct allows air to flow between the first duct and the second duct, and therefore unwanted substances such as ozone or nitrogen oxides (NOx) can be exhausted easily from the removable side (user operation side) to the opposite side to the removable side.

In the present invention, an embodiment in which at least one duct portion of the first duct portion and the second duct portion is a box-like shaped duct portion that is open in one direction is possible.

With this feature, at least one duct portion of the first duct portion and the second duct portion is configured to be a box-like shaped duct portion that is open on one direction, and therefore the strength of the resin frame having the first duct portion and the second duct portion can be improved.

In the present invention, an embodiment in which the resin frame is at least one face that constitutes part of at least one duct of the first duct and the second duct, and the at least one face serves also as a reinforcing portion is possible.

With this feature, the strength of the resin frame can be further improved by the reinforcing portion that is served by at least one face that constitutes part of at least one of the first duct and the second duct in the resin frame.

In the present invention, an embodiment in which the image forming unit is a first unit provided between the first duct and the second duct, and the third duct includes a first unit duct that is partly constituted by a portion of the first unit is possible.

With this feature, with the first unit duct that is partly constituted by a portion of the first unit, the third duct allows unwanted substances to be exhausted reliably from the first unit, and the first unit to be cooled reliably.

In the present invention, an embodiment in which the resin frame is provided with a first air hole that allows air to flow between the first duct and the first unit is preferable.

With this feature, the first air hole allows air to flow between the first duct and the first unit reliably.

In the present invention, an embodiment in which the resin frame is provided with a second air hole that allows air to flow between the second duct and the first unit is possible.

With this feature, the second air hole allows air to flow between the second duct and the first unit reliably.

In the present invention, an embodiment in which a portion of a case in the first unit constitutes at least a portion of the first unit duct is possible.

With this feature, a portion of the case in the first unit can be used to constitute at least a portion of the first unit duct, which can simplify the structure of the first unit duct.

In the present invention, an embodiment in which the case in the first unit that constitutes at least a portion of the first unit duct is provided with a vent hole for allowing air to flow between the first duct and the second duct is preferable.

With this feature, the case in the photosensitive unit is provided with vent holes, and therefore air inside the first unit can flow between the first duct and the second duct. This makes it possible to exhaust unwanted substances such as ozone or nitrogen oxides (NOx) inside the first unit and to cool the inside of the first unit reliably.

In the present invention, the resin frame may have a third duct portion that constitutes at least a portion of the first unit duct. In this case, an embodiment in which en external face of the case in the first unit that constitutes at least a portion of the first unit duct covers the third duct portion is preferable.

With this feature, a gap between a portion of the bottom face of the case in the first unit and the third duct portion can be used to constitute at least a portion of the first unit duct, which leads to space saving and can simplify the structure of the first unit duct.

In the present invention, an embodiment in which the plurality of first units are arranged side by side along an image forming direction can be shown as an example. In this case, an embodiment in which the image forming unit includes a second unit provided outside the plurality of first units in the image forming direction, the third duct includes a second unit duct that is partly constituted by a portion of the second unit, and the resin frame is provided with an air flow guide that allows air to flow between the first duct and the second unit is preferable.

With this feature, air can flow reliably in the second unit provided outside the first unit in the image forming direction, and therefore unwanted substances such as ozone or nitrogen oxides (NOx) can be exhausted from the second unit, and the second unit can be cooled reliably.

In the present invention, an embodiment in which an exhaust fan is provided that exhausts air from the one side through the first duct, the third duct and the second duct to the other side is preferable.

With this feature, the exhaust fan makes it possible to exhaust forcedly air from the removable side to the opposite side through the first duct, the third duct and the second duct.

In the present invention, an embodiment in which the image forming unit includes a color image forming unit is possible.

With this feature, air can flow reliably to the color image forming units, and therefore unwanted substances can be exhausted reliably from the color image forming units and the color image forming units can be cooled reliably.

As described above, according to the present invention, the image forming apparatus is provided with the first duct for allowing air to flow on the one side, the second duct for allowing air to flow on the other side, and the third duct for allowing air to flow between the first duct and the second duct Therefore, air can flow not only in the first duct on the one side, but also in the third duct and furthermore the second duct on the opposite side. For this reason, air can flow reliably to the image forming unit, and therefore unwanted substances such as ozone or nitrogen oxides (NOx) can be exhausted reliably from the image forming unit, and the image forming unit can be cooled reliably. In addition, the resin frame has the first duct portion constituting at least a portion of the first duct, and the second duct portion constituting at least a portion of the second duct, and therefore the strength of the resin frame can be improved.

BRIEF DESCRIPTION OF THE DRAWINGS

FIG. 8A is a general cross-sectional view schematically showing a front portion of a photosensitive unit and a development unit that are fitted to the resin frame of the image forming apparatus shown in FIG. 1, and FIG. 8B is an enlarged cross-sectional view of an enlarged portion of a guide portion shown in FIG. 8A.

DESCRIPTION OF THE PREFERRED EMBODIMENTS

Hereinafter, embodiments of the present invention will be described with reference to the accompanying drawings. The embodiments described below are only examples in which the present invention is embodied, and are not intended to limit the technical scope of the present invention.

Outline of General Structure of Image Forming Apparatus

Figure 1:
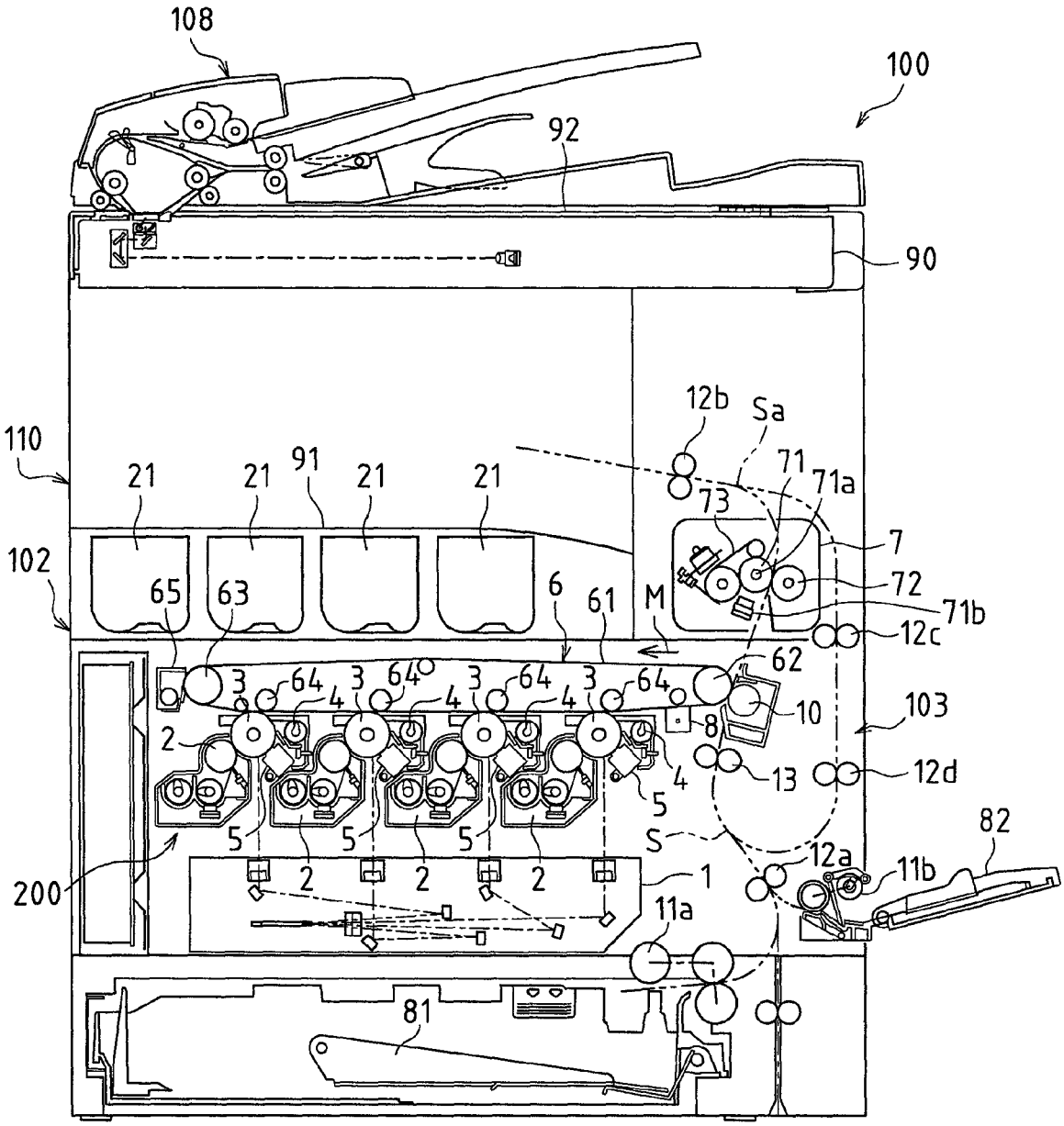
FIG. 1 is a schematic cross-sectional view of an image forming apparatus of an embodiment of the present invention when viewed from the front.

FIG. 1 is a schematic cross-sectional view of an image forming apparatus 100 according to an embodiment of the present invention when viewed from the front.

The image forming apparatus 100 shown in FIG. 1 is a color image forming apparatus that forms multicolor or monochrome images on a sheet such as recording paper (hereinafter, referred to as recording sheet) in accordance with image data transmitted from the outside. The image forming apparatus 100 includes an original reading device 108 and a apparatus body 110, and the apparatus body 110 includes an image forming portion 102 and a sheet conveying system 103.

The image forming portion 102 includes a light exposure unit 1, a plurality of development units 2, a plurality of photosensitive units 4, an intermediate transfer belt unit 6, a pre-transfer charging unit 8, a plurality of toner cartridge units 21, and a fixing unit 7. In this embodiment, the light exposure unit 1, the development units 2, the photosensitive units 4, the intermediate transfer belt unit 6, and the toner cartridge units 21 function as a plurality of removable image forming units 200 that have different image forming operations. It should be noted that the photosensitive unit 4 is formed as an integral unit in which a photosensitive unit, a charging unit and cleaning unit are combined in this embodiment.

The sheet conveying system 103 includes a paper feed tray 81, a manual paper feed tray 82 and a paper discharge tray 91.

An original placement plate 92 made of transparent glass on which an original (document sheet) is placed is provided above the apparatus body 110, and an optical unit 90 for reading an original is provided below the original placement plate 92. The original reading device 108 is provided above the original placement plate 92. The original reading device 108 conveys automatically an original onto the original placement plate 92. The original reading device 108 is attached pivotally to the apparatus body 110 with the front side openable, and an original can be placed manually after exposing the surface of the original placement place 92. It should be noted that in this embodiment, the front side of the apparatus body 110 is an attachment side from which the toner cartridge units 21, the photosensitive units 4, the development units 2, and the pre-transfer charging unit 8 can be removed.

The original reading device 108 can read an original automatically conveyed or an original placed on the original placement plate 92. The entire image of the original read by the original reading device 108 is transmitted as image data to the apparatus body 110 of the image forming apparatus 100, and an image formed based on the image data is recorded on a recording sheet in the apparatus body 110.

The image data that can be processed in the image forming apparatus 100 is that corresponding to color images using multiple colors (black (K), cyan (C), magenta (M), yellow (Y) in this embodiment). Therefore, for each unit group of the development units 2, the photosensitive units 4 and the toner cartridge units 21, a plurality of units (four in this embodiment, respectively corresponding to black, cyan, magenta and yellow) are provided, such that images of multiple kinds (four kinds in this embodiment) corresponding to four colors can be formed, and accordingly a plurality of image stations (four image stations in this embodiment) are configured.

In the photosensitive units 4, the chargers 5 are charging means for uniformly charging the surface of photosensitive drums 3 to a predetermined potential, and for the chargers 5, chargers of roller type or brush type, which are contact type, can be used, as well as chargers as shown in FIG. 1.

The light exposure unit 1 is configured in a form of a laser scanning unit (LSU) provided with a laser irradiating portion and reflection mirrors. The light exposure unit 1 is provided with a polygon mirror scanned by a laser beam, and optical elements such as lenses or mirrors for guiding the laser light reflected by the polygon mirror to the photosensitive drum 3. For the light exposure unit 1, other concepts can be used, such as a concept employing a writing head in which optical elements such as EL (electroluminescence) elements or LEDs (light-emitting diodes) are aligned in an array.

The light exposure unit 1 irradiates the photosensitive drums 3 that are charged in accordance with input image data with light so that an electrostatic latent image in accordance with the image data is formed on the surfaces of the photosensitive drums 3.

The toner cartridge units 21 are units containing toner, and are configured such that the toner is supplied to the development baths of the development units 2. In the apparatus body 110 of the image forming apparatus 100, the toner supplied from the toner cartridge units 21 to the development baths of the development units 2 is controlled such that the toner concentration of a developer in the development baths is constant.

The development units 2 make the electrostatic latent images formed on the respective photosensitive drums 3 visible with four color toners (Y, M, C, and K). The photosensitive units 4 have a cleaning function of removing and recovering toner that is left on the surfaces of the photosensitive drums 3 that have undergone development and image transfer.

The intermediate transfer belt unit 6 arranged above the photosensitive drums 3 includes an intermediate transfer belt 61 serving as an intermediate transfer member, an intermediate transfer belt driving roller 62, an intermediate transfer belt idle roller 63, a plurality of intermediate transfer belt rollers 64, and an intermediate transfer belt cleaning unit 65.

For the intermediate transfer belt rollers 64, four rollers are provided corresponding respectively to colors Y, M, C, and K. The intermediate transfer belt driving roller 62 supports the intermediate transfer belt 61 in cooperation with the intermediate transfer belt idle roller 63 and the intermediate transfer belt rollers 64 such that the intermediate transfer belt 61 is in tension. When the intermediate transfer belt driving roller 62 is rotated, then the intermediate transfer belt 61 is revolved in the movement direction (direction indicated by arrow M in FIG. 1), which causes the intermediate transfer belt idle roller 63 and the intermediate transfer belt rollers 64 to rotate idly.

The intermediate transfer belt rollers 64 are supplied with a transfer bias for transferring a toner image formed on the photosensitive drums 3 onto the intermediate transfer belt 61.

The intermediate transfer belt 61 is provided in such a manner that it is in contact with each of the photosensitive drums 3. A toner image of each color formed on the respective photosensitive drums 3 is sequentially transferred to the intermediate transfer belt 61 so as to be superimposed one after another, so that a color toner image (multicolor toner image) can be formed on the surface of the intermediate transfer belt 61. The intermediate transfer belt 61 is formed by an endless belt made of a film having a thickness of about 100 μm to 150 μm.

Toner images are transferred from the photosensitive drums 3 to the intermediate transfer belt 61 by means of the intermediate transfer belt rollers 64 that are in contact with the back face of the intermediate transfer belt 61. The intermediate transfer belt rollers 64 are supplied with a high voltage transfer bias (high voltage having an opposite polarity (+) to the polarity (−) of the charged toner) for transferring toner images. Each intermediate transfer belt roller 64 is made by forming its core with a metal (e.g., stainless steel) shaft having a diameter of 8 mm to 10 mm and covering the surface of the core with a conductive elastic material (e.g., resin materials such as EPDM (ethylene propylene diene rubber) or foamed urethane). The intermediate transfer belt rollers 64 serve as transfer electrodes that apply a high voltage uniformly to the intermediate transfer belt 61 with the conductive elastic material. Although roller-like transfer electrodes are used as the transfer electrodes, other transfer electrodes, for example, brush-like transfer electrodes can be used.

As described above, toner images that are made visible in accordance with the color phases on the respective photosensitive drums 3 are layered on the intermediate transfer belt 61. The toner images layered on the intermediate transfer belt 61 are transferred onto a recording sheet by a transfer roller 10 constituting a second transfer mechanism portion disposed in a contact position in which the recording sheet is in contact with the intermediate transfer belt 61, by means of the rotational movement of the intermediate transfer belt 61. However, as the configuration of the second transfer mechanism portion, not only transfer rollers, but also other transfer configurations such as those employing corona chargers or transfer belts can be used.

At this time, the transfer roller 10 is supplied with a voltage (high voltage having an opposite polarity (+) of the polarity (−) of the charged toner) for transferring toner onto a recording sheet in a state where a transfer nip is formed between the transfer roller 10 and the intermediate transfer belt 61. The transfer nip is formed between the transfer roller 10 and the intermediate transfer belt 61 by the transfer roller 10 and the intermediate transfer belt driving roller 62 pressing against each other. In order to obtain the transfer nip steadily, either one of the transfer roller 10 and the intermediate transfer belt driving roller 62 is a hard roller made of a rigid material (such as metal) and the other is an elastic roller made of a soft material (elastic rubber or resin materials such as foamed resin).

When transferring a toner image from the intermediate transfer belt 61 onto a recording sheet with the transfer roller 10, toner may remain on the intermediate transfer belt 61 without being transferred onto the recording sheet. The toner that has remained on the intermediate transfer belt 61 may cause mixture of colors in subsequent processes. Therefore, the toner that has remained on the intermediate transfer belt 61 is removed and recovered by the intermediate transfer belt cleaning unit 65. More specifically, the intermediate transfer belt cleaning unit 65 is provided with a cleaning member (e.g., a cleaning blade) that is in contact with the intermediate transfer belt 61. The idle roller 63 supports the intermediate transfer belt 61 from the inside (back face side), and the cleaning member is in contact with the intermediate transfer belt 61 so as to press against it toward the idle roller 63 from the outside.

A pre-transfer charging unit 8 includes a pre-transfer charger (PTC), and is provided near the intermediate transfer belt 61 on the upstream side from the transfer nip between the transfer roller 10 and the intermediate transfer belt 61 and on the downstream side from the photosensitive units 4 in the movement direction M of the intermediate transfer belt 61.

Incidentally, the toner images that are transferred from the photosensitive drums 3 onto the intermediate transfer belt 61 include halftone areas or solid areas, or include areas having different numbers of toner layers, and therefore the charge level may vary from area to area. Furthermore, the charge level within a toner image on the intermediate transfer belt 61 after the first transfer may be varied by exfoliation discharges generated in a gap on the downstream side adjacent to the first transfer portion in the movement direction M of the intermediate transfer belt 61. The variations in the charge level in the same toner image of this kind decrease the transfer margin when transferring a toner image on the intermediate transfer belt 61 onto a sheet.

For this reason, the pre-transfer charging unit 8 is used to charge a toner image uniformly before transferring it onto a sheet, so that the variations in the charge level in the same toner image are cancelled, which makes it possible to improve the transfer margin in the second transfer.

The paper feed tray 81 is a tray accommodating in advance recording sheets on which an image is to be formed (printed), and is provided below the light exposure unit 1 in the apparatus body 110. On the manual paper feed tray 82, recording sheets on which an image is to be formed (printed) are placed. The paper discharge tray 91 is provided above the image forming portion 102 in the apparatus body 110, and recording sheets on which an image has been formed (printed) are accumulated face-down on the paper discharge tray 91.

Furthermore, the apparatus body 110 is provided with a sheet conveying path S for conveying a recording sheet that has been conveyed from the paper feed tray 81 or the manual paper feed tray 82 and has passed the transfer roller 10 and the fixing unit 7 to the paper discharge tray 91. Arranged in the vicinity of the sheet conveying path S are pickup rollers 11*a* and 11*b*, a plurality of conveying rollers 12*a* to 12*d*, a registration roller 13, the transfer roller 10, a heat roller 71 and a pressing roller 72 of the fixing unit 7.

The conveying rollers 12*a* to 12*d* are small rollers for promoting and assisting conveying of the recording sheets, and are provided along the sheet conveying path S. The pickup roller 11*a* is provided in the vicinity of the paper feed tray 81 on the sheet supply side for picking up the recording sheets one by one from the paper feed tray 81 and supplies the sheets to the sheet conveying path S. Similarly, the pickup roller 11*b* is provided in the vicinity of the manual paper feed tray 82 on the sheet supply side for picking up the recording sheets one by one from the manual paper feed tray 82 and supplies the sheets to the sheet conveying path S.

The registration roller 13 temporarily holds the recording sheet that is being conveyed in the sheet conveying path S. Then, the registration roller 13 conveys the recording sheet to the transfer roller 10 at a timing at which the leading edge of the toner image on the photosensitive drums 3 is aligned with the leading edge of the recording sheet.

The fixing unit 7 fixes an unfixed toner image onto the recording sheet, and includes the heat roller 71 and the pressing roller 72 that serve as fixing rollers. When being rotated, the heat roller 71 conveys the recording sheet while sandwiching the recording sheet along with the pressing roller 72 that idly rotates. The heat roller 71 is heated with a heater 71*a* provided inside it, and is maintained at a predetermined fixing temperature based on a signal from a temperature detector 71*b*. The heat roller 71 heated with the heater 71*a* performs thermo-compression bonding of a multicolor toner image transferred onto the recording sheet on the recording sheet along with the pressing roller 72, so that the multicolor toner image is melted, mixed, and pressed and thus is thermo-fixed onto the recording sheet. The fixing unit 7 is also provided with an external heating belt 73 for heating the heat roller 71 from the outside.

In the image forming apparatus 100 configured in the above described manner, when there is a request for simplex printing on a recording sheet, a recording sheet supplied from the paper feed tray 81 or 82 is conveyed to the registration roller 13 with the conveying roller 12*a* provided along the sheet conveying path S, and is conveyed with the transfer roller 10 at a timing on which the leading edge of the recording sheet is aligned with the leading edge of the toner image on the intermediate transfer belt 61, and then the toner image is transferred onto the recording sheet. Thereafter, the recording sheet passes the fixing unit 7 so that unfixed toner on the recording sheet is melted by heat and adheres to the recording sheet, and then the recording sheet is discharged onto the paper discharge tray 91 through the conveying roller 12*b*.

When there is a request for duplex printing on a recording sheet, the simplex printing as described above is completed, and in a state where the tailing edge of the recording sheet that has passed the fixing unit 7 is positioned between the last conveying roller 12*b* and a branching portion Sa on the sheet conveying path S, the conveying roller 12*b* is reversely rotated, so that the recording sheet is guided to the conveying rollers 12*c* and 12*d*. Then, the recording sheet that has been conveyed to the transfer nip through the registration roller 13 undergoes printing on its back face, and then is discharged onto the paper discharge tray 91.

Regarding Resin Frame

Figure 2:
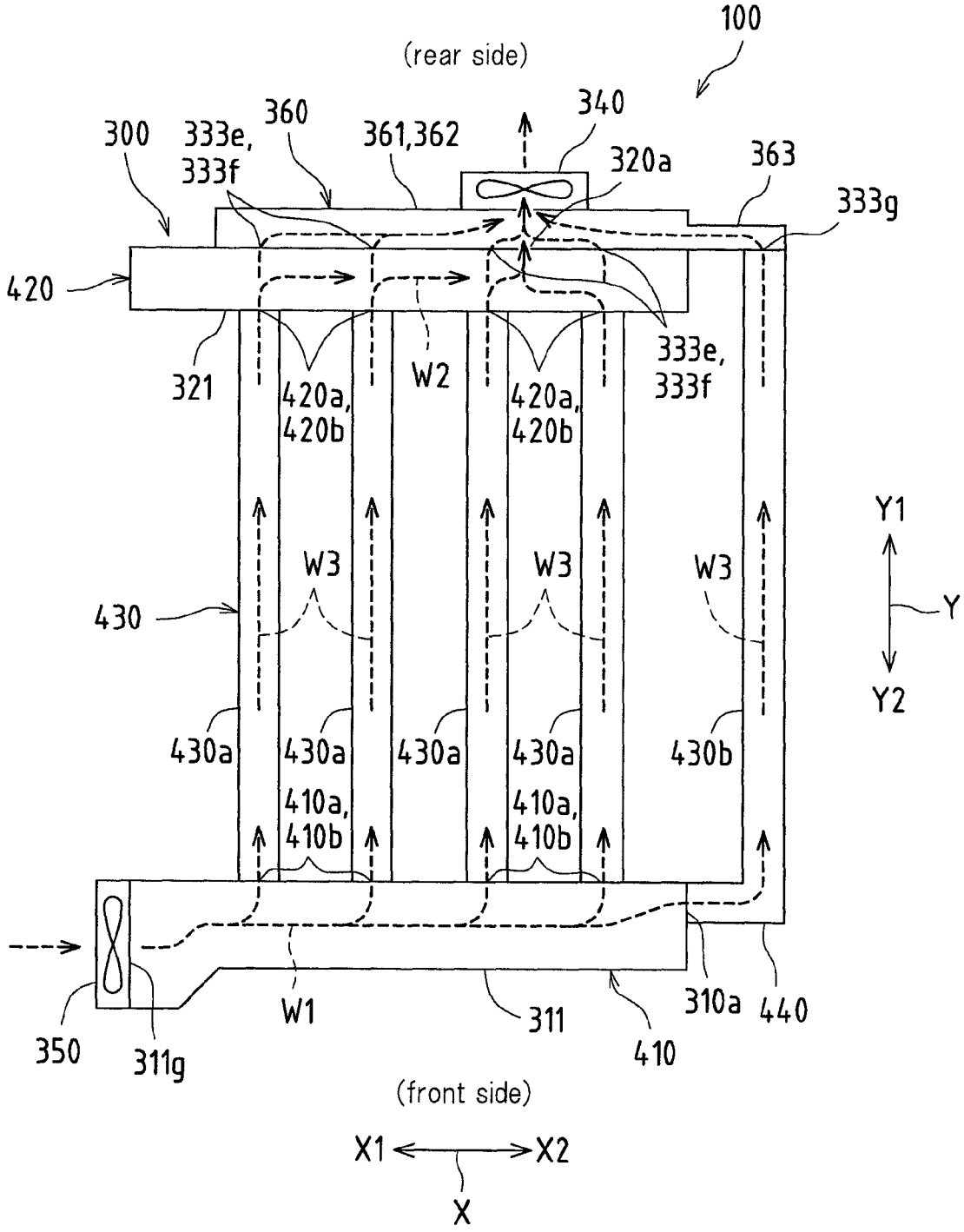
FIG. 2 is a block diagram schematically showing a resin frame provided a first duct, a second duct and a third duct in the image forming apparatus shown in FIG. 1.

FIG. 2 is a block diagram schematically showing a resin frame 300 including a first duct 410, a second duct 420 and a third duct 430 in the image forming apparatus 100 shown in FIG. 1.

Figure 3:
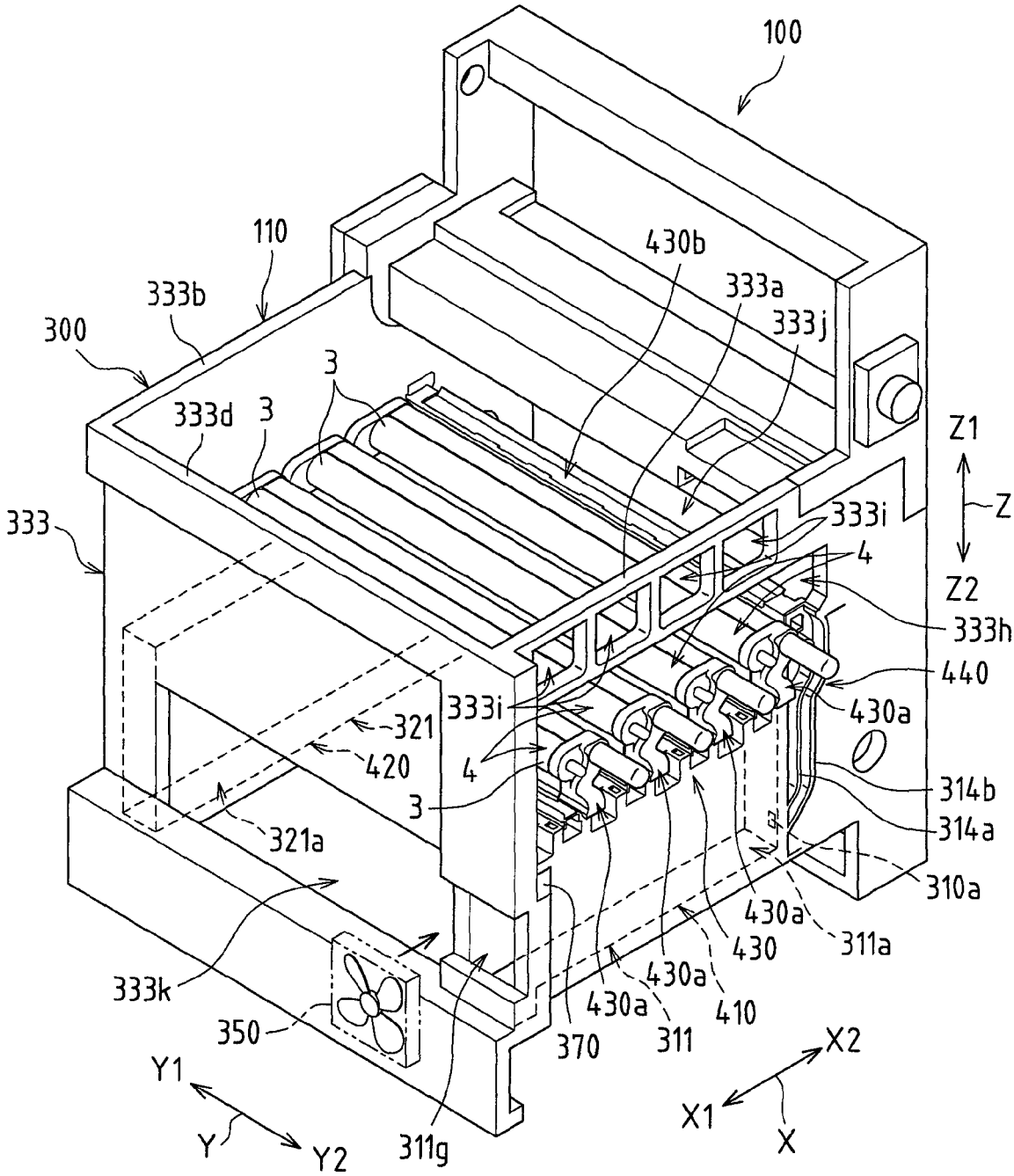
FIG. 3 is a general isometric view of a resin frame to which photosensitive units are fitted in the image forming apparatus shown in FIG. 1 when viewed diagonally down from the upper front left.
Figure 4:
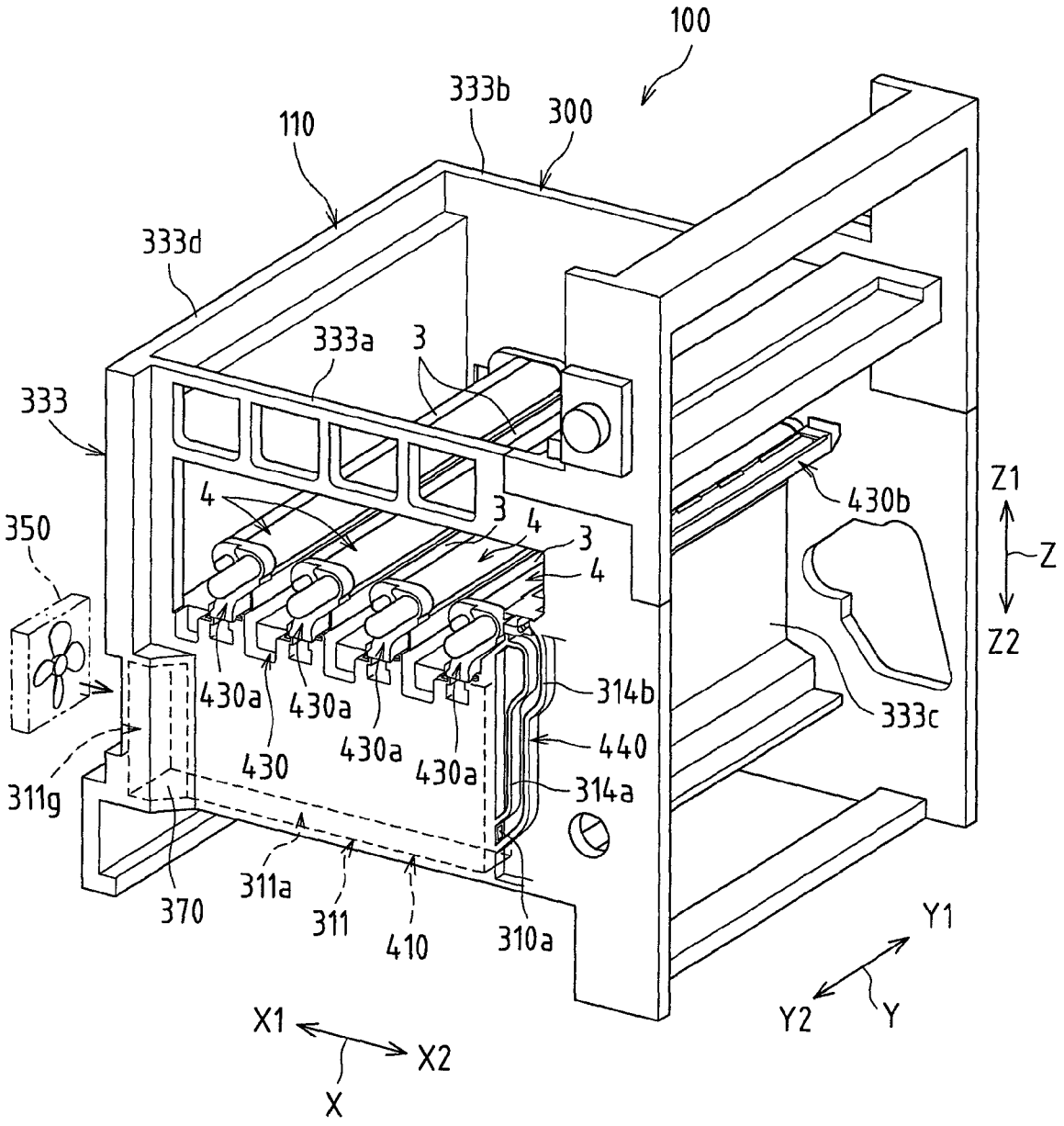
FIG. 4 is a general isometric view of the resin frame to which photosensitive units are fitted in the image forming apparatus shown in FIG. 1 when viewed diagonally down from the upper front right.
Figure 5:
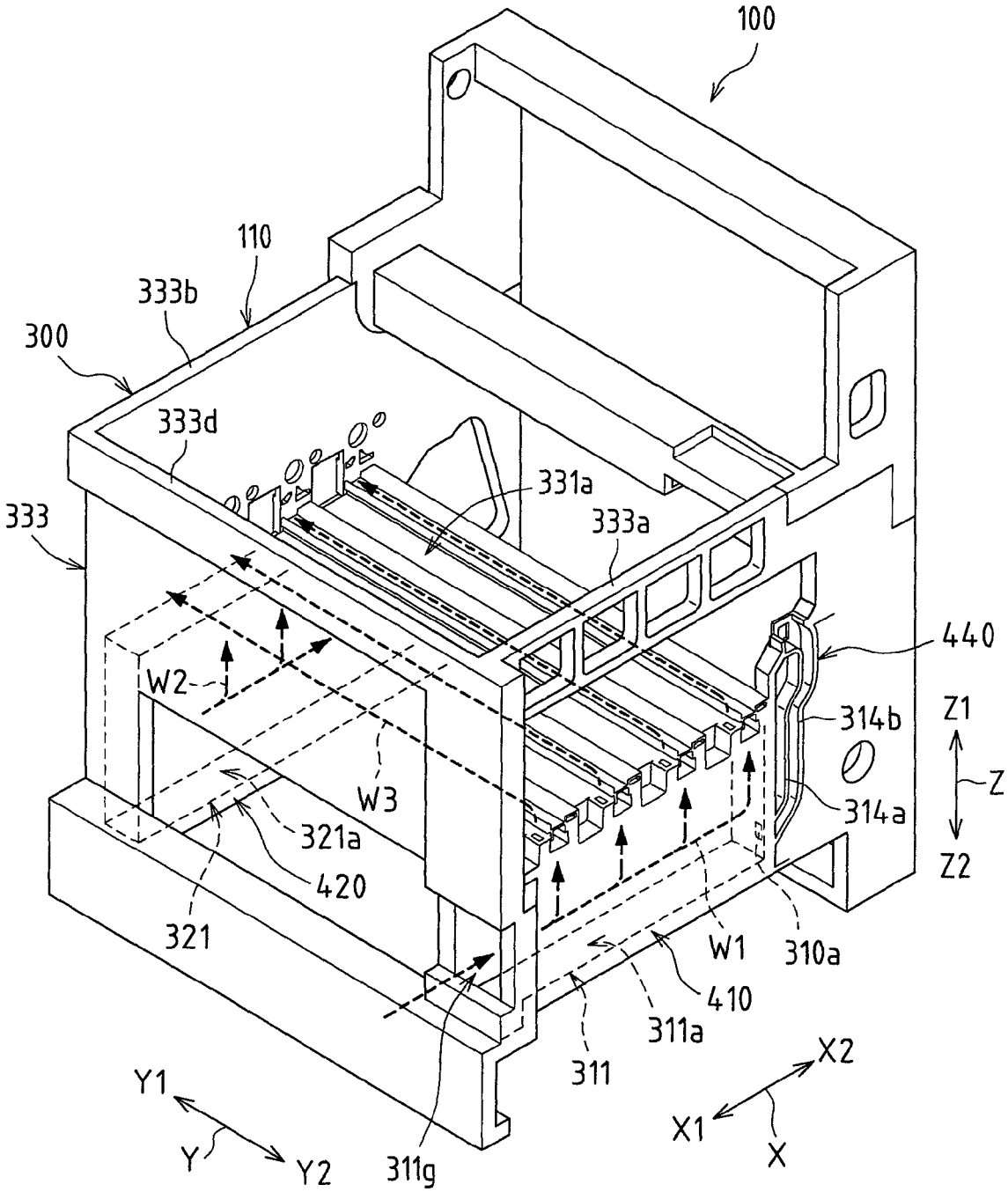
FIG. 5 is a general isometric view of the resin frame from which the photosensitive units are removed in the image forming apparatus shown in FIGS. 3 and 4 when viewed diagonally down from the upper front left.
Figure 6:
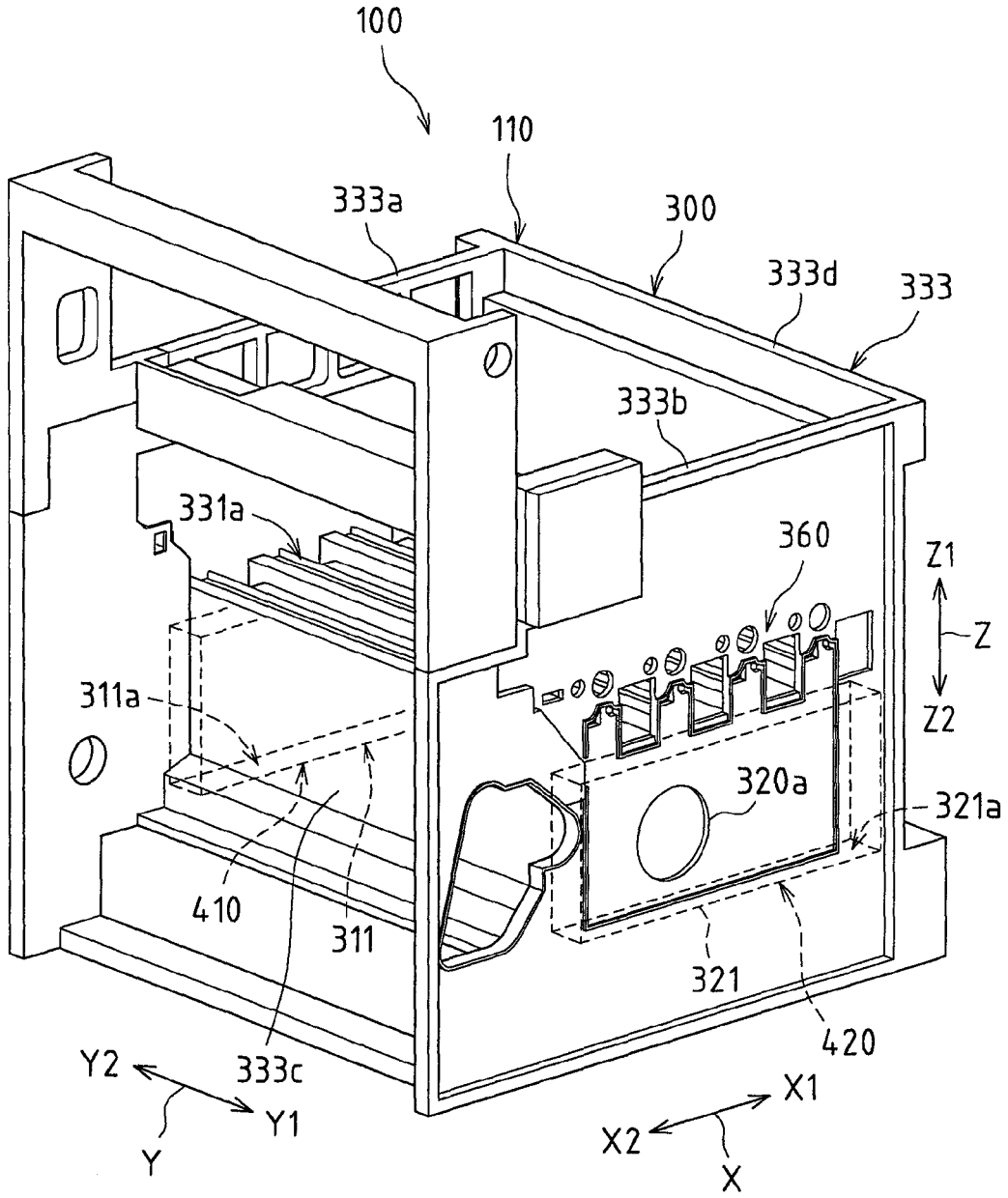
FIG. 6 is a general isometric view of the resin frame from which the photosensitive units are removed in the image forming apparatus shown in FIGS. 3 and 4 when viewed diagonally down from the upper back right.
Figure 7:
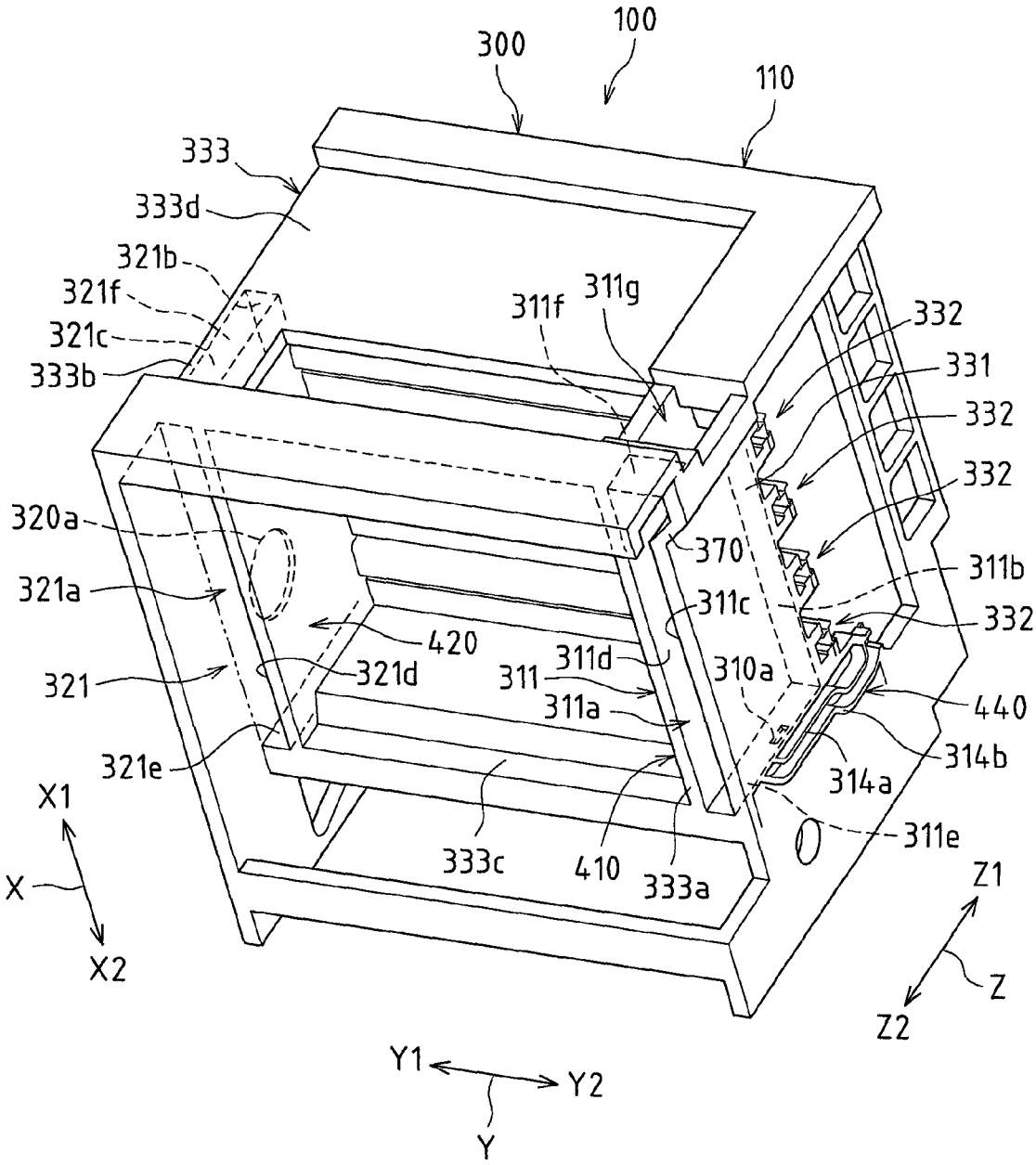
FIG. 7 is a general isometric view of the resin frame from which the photosensitive units are removed in the image forming apparatus shown in FIGS. 3 and 4 when viewed diagonally up from the lower back left.

FIGS. 3 and 4 are general isometric views of the resin frame 300 to which photosensitive units 4 are fitted in the image forming apparatus 100 shown in FIG. 1 when viewed diagonally down from the upper front left and diagonally down from the upper front right, respectively. FIGS. 5 to 7 are general isometric views of the resin frame 300 from which the photosensitive units 4 are removed in the image forming apparatus shown in FIGS. 3 and 4 when viewed diagonally down from the upper front left, diagonally down from the upper back right and diagonally up from the lower back left, respectively. Herein, "left" and "right" refer to respectively left and right when viewed from the front of the apparatus body 110. An arrow X in the drawings indicates the width direction of the apparatus body 110, an arrow Y indicates the depth direction of the apparatus body 110, and an arrow Z indicates the vertical direction of the apparatus body 110.

The image forming apparatus 100 of this embodiment further includes a resin frame 300 made of resin and a first duct 410, a second duct 420 and a third duct 430. The resin frame 300 is formed integrally with a synthetic resin.

As shown in FIG. 2, the first duct 410 serves to allow air W1 to flow on the removable side (front side) of at least one unit (herein, the photosensitive unit 4 and the development unit 2) of the plurality of image forming units 200. The second duct 420 serves to allow air W2 to flow on the opposite side (rear side) to the removable side of the photosensitive unit 4 and the development unit 2. The third duct 430 serves to allow air W3 to flow between the first duct 410 and the second duct 420.

As shown in FIGS. 3 to 7, the resin frame 300 has a first duct portion 311 that constitutes at least a portion of the first duct 410 and a second duct portion 321 that constitutes at least a portion of the second duct 420.

In this embodiment, as shown in FIG. 7, at least one duct portion of the first duct portion 311 and the second duct portion 321 (herein, both the duct portions 311, 321) has a box-like shape having opening portions 311*a* and 321*a* that are open in one direction (herein, lower face).

In this embodiment, the resin frame 300 has at least one face (herein, inner upper face 311*b*, first inner side face 311*c*, second inner side face 311*d*, third inner side face 311*e* and fourth inner side face 311*f*) that constitutes part of the first duct 410, and the inner upper face 311*b*, the first inner side face 311*c*, the second inner side face 311*d*, the third inner side face 311*e* and the fourth inner side face 311*f* serve also as reinforcing portions.

More specifically, the inner upper face 311*b* extends in the width direction X of the apparatus body 110, and the first inner side face 311*c* on the front side (Y2 side) and the second inner side face 311*d* on the rear side (Y1 side) extend from the opposite ends in the short side direction (depth direction Y of the apparatus body 110) of the inner upper face 311*b* perpendicularly or substantially perpendicularly downward. The third inner side face 311*e* on the right side and the fourth inner side face 311*f* on the left side extend from the opposite ends in the width direction X of the inner upper face 311*b* perpendicularly or substantially perpendicularly downward. An air intake port 311*g* for drawing in air by means of an air intake fan 350 as described later is provided on one end portion (herein, fourth side plate having the fourth inner side face 311*f*) of the first duct 410 in the width direction X of the apparatus body 110.

Furthermore, an air discharge port 310*a* for discharging air to an auxiliary duct 440 as described later is provided on the other side (herein, third side plate having the third inner side face 311*e*) of the first duct 410 in the width direction X of the apparatus body 110. When molding the first duct portion 311, a die can be inserted from the opening portion 311*a*.

In this embodiment, the opening portion 311*a* of the first duct portion 311 is blocked by a part (not shown) of a member (herein, a member constituting part of the light exposure unit 1) that is located adjacent to the first duct 410. Thus, in the first duct 410, air can flow reliably from the air intake port 311*g* to first air holes 410*a*, 410*b* as described later (see FIGS. 8A, 8B and FIG. 13) and the air discharge port 310*a*.

It should be noted that the first duct 410 may have the first duct portion 311 and a blocking member (e.g., sheet-like member of, for example, a seal or a film) that blocks the opening portion 311*a* of the first duct portion 311. In this case, for example, the opening portion 311*a* can be closed by providing the blocking member in a peripheral portion of the first duct 410.

In this embodiment, the resin frame 300 has at least one face (herein, inner upper face 321*b*, first inner side face 321*c*, second inner side face 321*d*, third inner side face 321*e* and fourth inner side face 321*f*) that constitutes part of the second duct 420, and the inner upper face 321*b*, the first inner side face 321*c*, the second inner side face 321*d*, the third inner side face 321*e* and the fourth inner side face 321*f* serve also as reinforcing portions.

More specifically, the inner upper face 321*b* extends in the width direction X of the apparatus body 110, and the first inner side face 321*c* on the rear side (Y1 side) and the second inner side face 321*d* on the front side (Y2 side) extend from the opposite ends in the short side direction (depth direction Y of the apparatus body 110) of the inner upper face 321*b* perpendicularly or substantially perpendicularly downward. The third inner side face 321*e* on the right side and the fourth inner side face 321*f* on the left side extend from the opposite ends in the width direction of the inner upper face 321*b* perpendicularly or substantially perpendicularly downward. An air discharge port 320*a* for discharging air to an exhaust fan 340 as described later is provided in the second duct 420 (herein, first side plate having the first inner side face 321*c*). When molding the second duct portion 321, a die can be inserted from the opening portion 321*a*.

In this embodiment, the opening portion 321*a* of the second duct portion 321 is blocked by a part (not shown) of a member (herein, a member constituting part of the light exposure unit 1) that is located adjacent to the second duct portion 321. Thus, in the second duct portion 321, air can flow reliably from second air holes 420*a*, 420*b* as described later (see FIG. 13) to the air discharge port 320*a*. It should be noted that the second duct 420 may have the second duct portion 321 and a blocking member (e.g., sheet-like member of, for example, a seal or a film) that blocks the opening portion 321*a* of the second duct portion 321. In this case, for example, the opening portion 321*a* can be closed by providing the blocking member in a peripheral portion of the second duct 420.

In this embodiment, the photosensitive units 4 are supported by the resin frame 300, and are inserted and removed in the depth direction Y of the apparatus body 110. The resin frame 300 has a base 331, guide portions 332 and a side plate portion 333, as shown in FIG. 7. The base 331 has support faces 331*a* for supporting the photosensitive units 4 (see FIGS. 5 and 6). The guide portions 332 extend in the insertion direction Y1 in which the photosensitive units 4 are inserted into the apparatus body 110 in the base 331, and the side plate portion 333 extends in a direction (vertical direction Z) perpendicular to the support faces 331*a* in the peripheral portion of the base 331.

More specifically, the guide portions 332 guide the photosensitive units 4 in the insertion direction Y1 while regulating movement in orthogonal directions (including the width direction X and the vertical direction Z) orthogonal to the insertion direction Y1 of the photosensitive units 4. The side plate portion 333 has a first side plate portion 333*a* that is positioned on the front side of the apparatus body 110, a second side plate portion 333*b* that is positioned on the rear side of the apparatus body 110, a third side plate portion 333*c* that is positioned on the right side of the apparatus body 110, and a fourth side plate portion 333*d* that is positioned on the left side of the apparatus body 110. It should be noted that the first side plate portion 333*a* has the second inner side face 311*d*, and the second side plate portion 333*b* has the first inner side face 321*c*.

In this embodiment, the resin frame 300 is a resin frame configured to have an H-shape in cross section in which the plate-like base 331 is provided perpendicularly to the side plate portion 333 (herein, the first side plate portion 333*a* to fourth side plate portion 333*d*) between the upper end and the lower end in the vertical direction Z. More specifically, the first side plate portion 333*a* to fourth side plate portion 333*d* (corresponding to the vertical line in the H-shape) are coupled integrally to the plate-like base 331 (corresponding to the horizontal line in the H-shape) along the horizontal direction substantially in the middle position of the vertical direction Z.

The plurality of development units 2 are inserted and removed in the depth direction Y of the apparatus body 110 with the respective photosensitive units 4 interposed between the respective development units 2 in the width direction X of the apparatus body 110 (see FIG. 1).

In this embodiment, the photosensitive units 4 and the development units 2 serving as first units are a plurality of units located between the first duct 410 and the second duct 420 and having shapes that are elongated in the direction orthogonal to the first duct 410 (i.e., the first side plate portion 333*a*) and the second duct 420 (i.e., the second side plate portion 333*b*) (depth direction Y of the apparatus body 110). The plurality of photosensitive units 4 and the plurality of development units 2 are provided alternatively side by side in the image forming direction M (movement direction of the intermediate transfer belt 61) (see FIG. 1), that is, in the width direction X of the apparatus body 110 in this embodiment.

The first side plate portion 333*a* is provided with an opening portion 333*h* (see FIG. 3) that is open such that the plurality of development units 2 and the plurality of photosensitive units 4 can be inserted therein, and a plurality of opening portions 333*i* (see FIG. 3) that correspond to the respective toner cartridge units 21, and that are open so that the toner cartridge units 21 can be inserted in the corresponding opening portions. The third side plate portion 333*c* is provided with an opening portion 333*j* (see FIG. 3) that is open such that one end portion (herein, right end portion) of the intermediate transfer belt unit 6 can project toward the outside in the width direction X. The fourth side plate portion 333*d* is provided with an opening portion 333*k* (see FIG. 3) that is open so that components of various electrical systems such as a control substrate can be arranged.

In this embodiment, the third duct 430 includes a plurality of first unit ducts 430*a* that extend in the length direction of the plurality of photosensitive units 4 and the plurality of development units 2. The first unit ducts 430*a* are respectively partly constituted by a portion of the photosensitive units 4 and a portion of the development units 2.

Figure 8B:
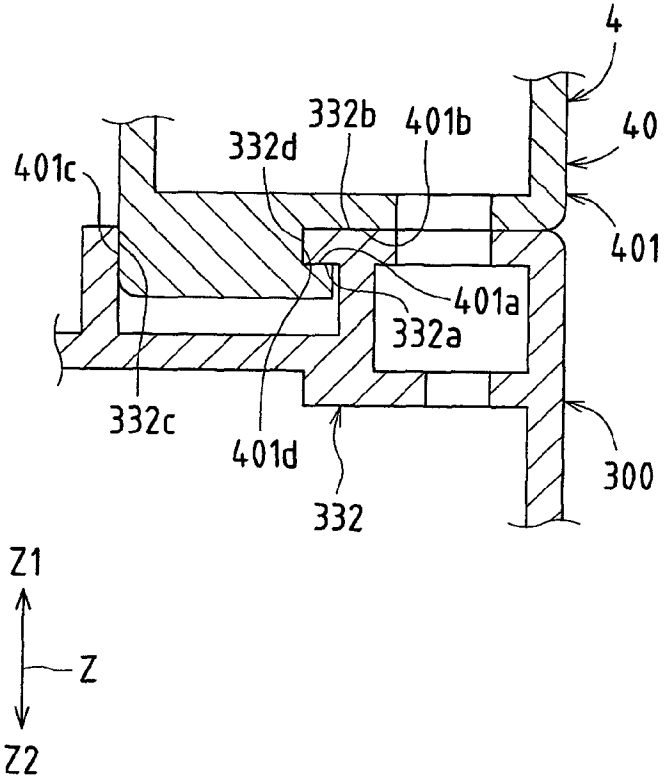
FIGS. 8A and 8B are diagrams for illustrating the first unit ducts.
Figure 8A:
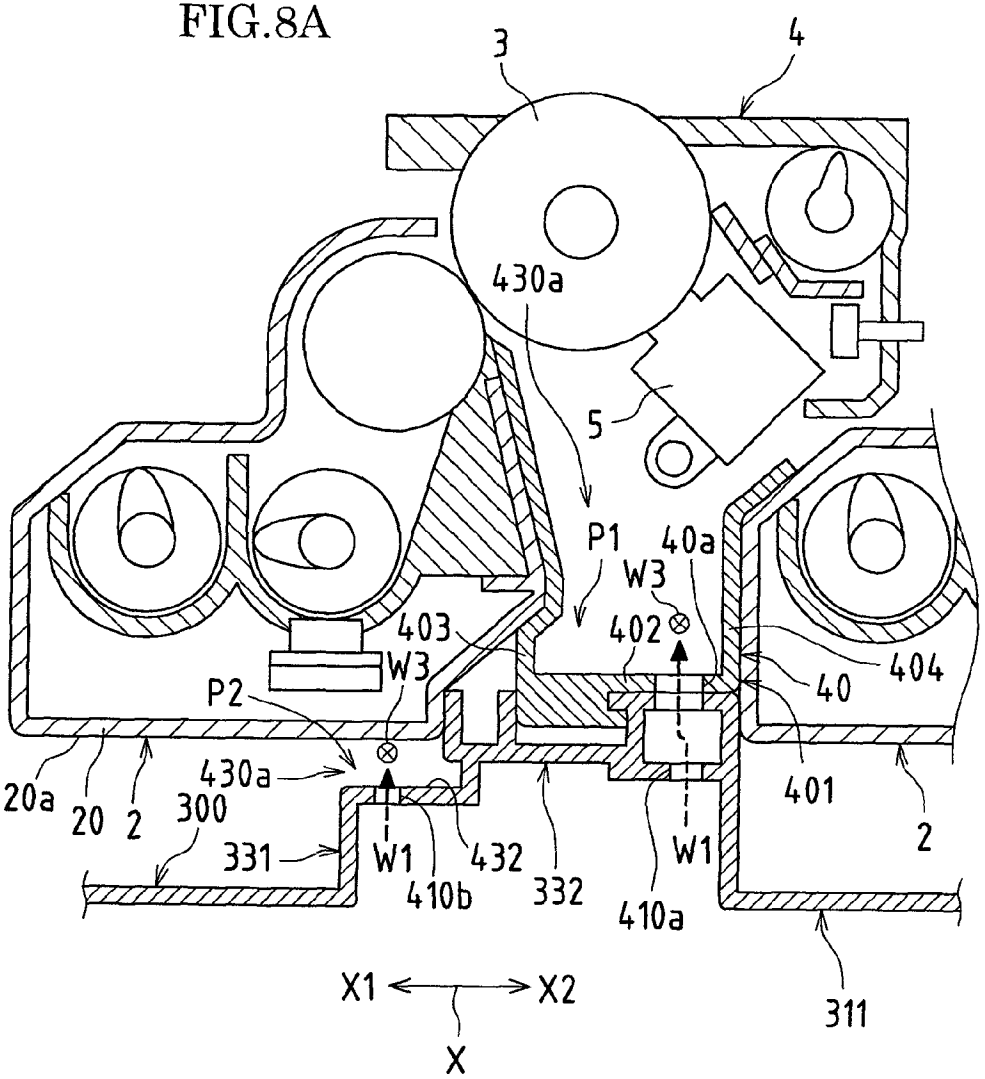
Figure 9:
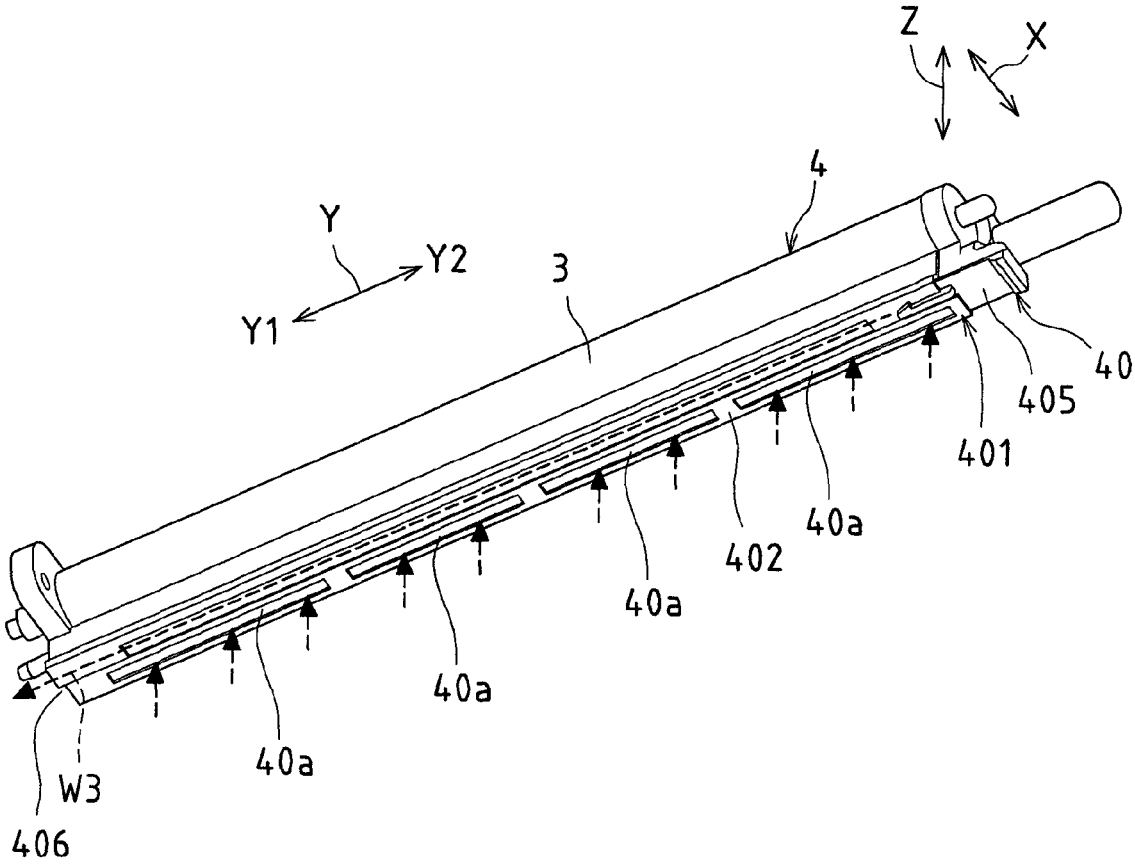
FIG. 9 is a general isometric view of the photosensitive unit when viewed substantially from below.

FIGS. 8A and 8B are diagrams for illustrating the first unit ducts 430*a*. FIG. 8A is a general cross-sectional view schematically showing a front portion of the photosensitive unit 4 and the development unit 2 that are fitted to the resin frame 300 of the image forming apparatus 100 shown in FIG. 1. FIG. 8B is an enlarged cross-sectional view of an enlarged portion of a guide portion 332 shown in FIG. 8A FIGS. 9 to 11 are general isometric views of the photosensitive unit 4 when viewed substantially from below, diagonally down from the upper back right, and diagonally down from the upper front left respectively. It should be noted that since all of the plurality of photosensitive units 4 have the same configuration, a single photosensitive unit is shown in FIGS. 8A to 11.

As shown in FIG. 8B, in this embodiment, the guide portion 332 has a first regulating portion 332*a* that limits movement of the photosensitive unit 4 in the upward direction Z1, a second regulating portion 332*b* that limits movement of the photosensitive unit 4 in the downward direction Z2, a third regulating portion 332*c* that limits movement of the photosensitive units 4 in the leftward direction X1, and a fourth regulating portion 332*d* that limits movement of the photosensitive units 4 in the right direction X2.

More specifically, the first regulating portion 332*a* to the fourth regulating portion 332*d* extend in the depth direction Y of the apparatus body 110, and slides in contact with a lower portion 401*a*, an upper portion 401*b*, a left side portion 401*c* and a right side portion 401*d* of a lower case portion 401 of the case 40 in the photosensitive unit 4 when the photosensitive unit 4 is inserted/removed to/from the apparatus body 110. Thus, the photosensitive units 4 can be guided in the insertion direction Y1 while their movement in the width direction X and the vertical direction Z is regulated.

As shown in FIGS. 8A to 11, in this embodiment, a portion of the case 40 in the photosensitive unit 4 constitutes at least a portion of the first unit duct 430*a*. Furthermore, in this embodiment, with respect to the development units 2, a portion of a case 20 constitutes at least a portion of the first unit duct 430*a*.

More specifically, the photosensitive unit 4 constituting at least a portion of the first unit duct 430*a* is provided with the lower case portion 401, which is an example of the first unit duct 430*a*, in a lower portion of the case 40. The case 40 in the photosensitive unit 4 is provided with vent holes (first vent holes 40*a* (see FIGS. 8A, 8B and 9) and a second vent hole 40*b* (see FIG. 10) in this embodiment).

Figure 10:
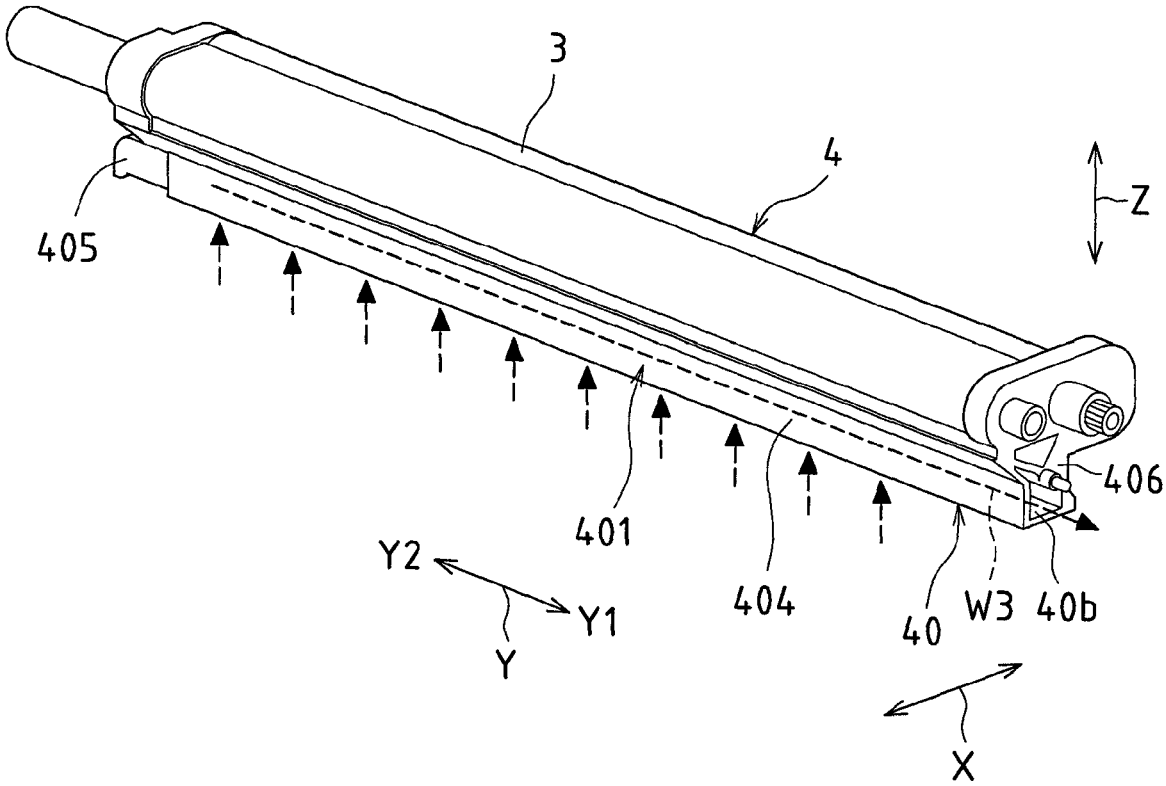
FIG. 10 is a general isometric view of the photosensitive unit when viewed from diagonally down from the upper back right.
Figure 11:
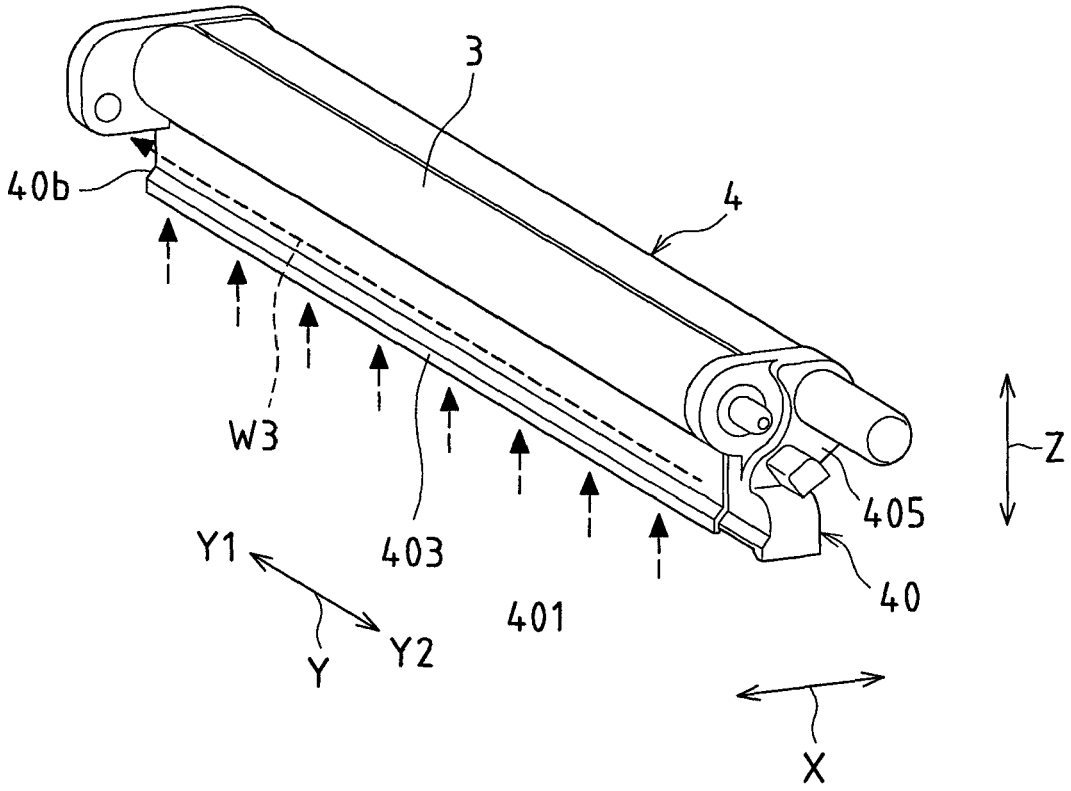
FIG. 11 is a general isometric view of the photosensitive unit when viewed from diagonally down from the upper front left.

The lower case portion 401 is provided with the first vent holes 40*a* that are open in a portion of the bottom face (see FIGS. 8A, 8B and 9) and the second vent hole 40*b* that is open in the downstream side end in the insertion direction Y1 (see FIG. 10).

More specifically, the lower case portion 401 has a bottom plate 402, a first side plate 403 (left side), a second side plate 404 (right side), a front member 405 and a rear member 406. The bottom plate 402 extends in the length direction (the depth direction Y of the apparatus body). The first side plate 403 and the second side plate 404 extend perpendicularly upward from the opposite end portions in the short side direction (the width direction X of the apparatus body 110) of the bottom plate 402. The bottom plate 402 is provided with the first vent holes 40*a* (a plurality of slit holes (four slit holes in the example shown in the drawings) extending in the insertion direction Y1 in this embodiment) (see FIG. 9). The rear member 406 is provided with the second vent hole 40*b* (see FIG. 10) that penetrates it in the depth direction Y of the apparatus body 110.

Therefore, in the first unit ducts 430*a*, spaces P1 are defined by the bottom plates 402, the first side plates 403, the second side plates 404, the front members 405 and the rear members 406, and the spaces P1 allow air to flow between the first vent holes 40*a* on the front side (on the first duct 410 side) of the apparatus body 110 and the second vent hole 40*b* on the rear side (on the second duct 420 side) thereof. It should be noted that in this embodiment, in the spaces P1, air from below is allowed to flow between the first vent holes 40*a* in the middle portion in the depth direction Y of the apparatus body 110 and the second vent hole 40*b* on the rear side thereof.

Figure 12:
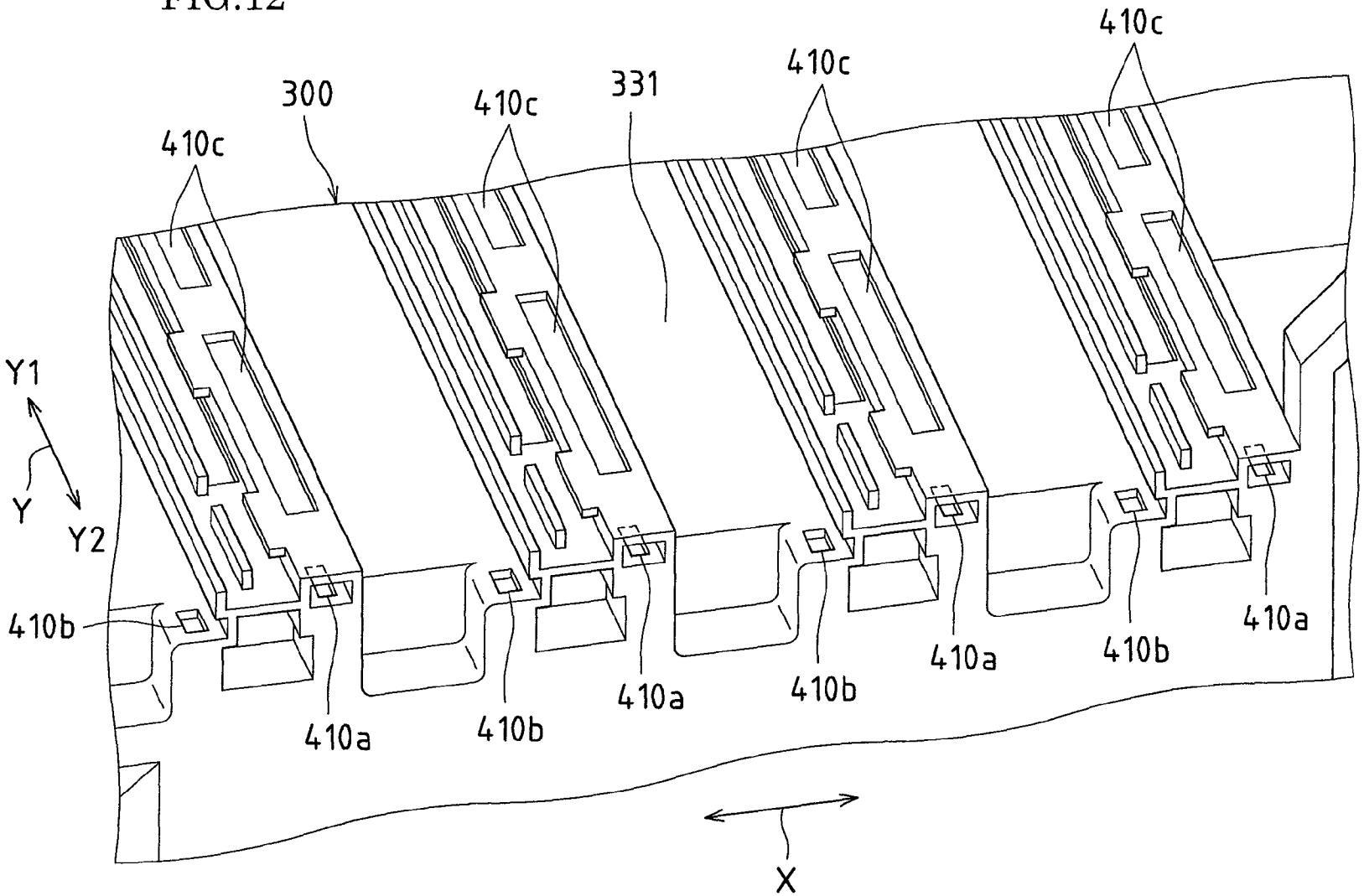
FIG. 12 is an isometric view showing an enlarged portion of the front side of the resin frame shown in FIG. 2 to FIGS. 8A and 8B.
Figure 13:
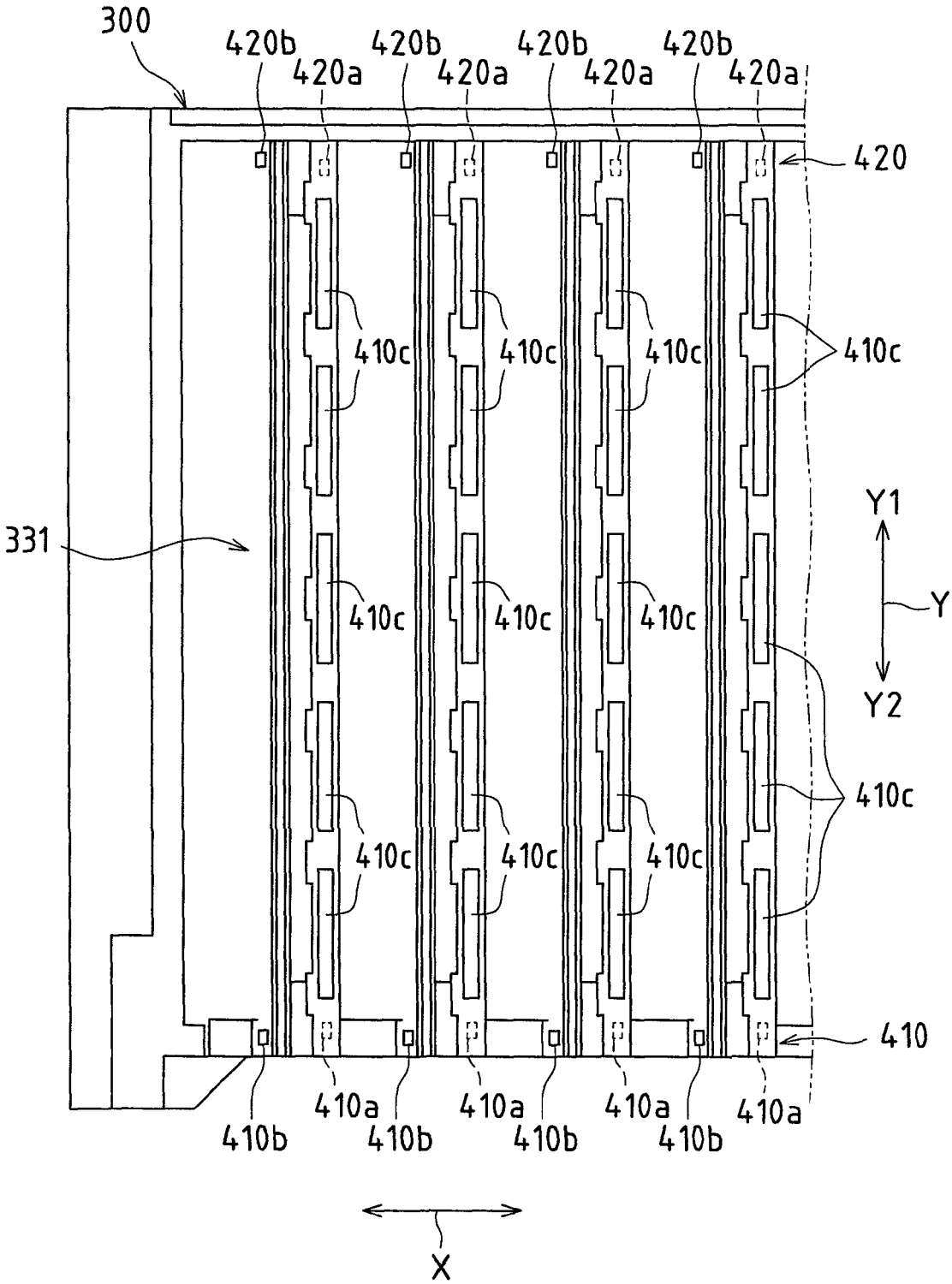
FIG. 13 is a general plan view schematically showing the resin frame shown in FIG. 2 to FIGS. 8A and 8B.

FIG. 12 is an isometric view showing an enlarged portion of the front side of the resin frame 300 shown in FIG. 2 to FIGS. 8A and 8B. FIG. 13 is a general plan view schematically showing the resin frame 300 shown in FIG. 2 to FIGS. 8A and 8B.

As shown in FIGS. 12 and 13, in this embodiment, the resin frame 300 is provided with photosensitive unit air holes, which are examples of first air holes 410*a* through which air flows between the first duct 410 and the plurality of photosensitive units 4, such that the photosensitive unit air holes respectively correspond to the plurality of photosensitive units 4. Thus, air W1 in the first duct 410 can move to the space P1 through the first air holes 410*a*.

More specifically, the first air holes 410*a* are provided, above the first duct 410, at positions corresponding to (and overlapping in the length direction of the first vent holes 40*a*) the upstream end portions in the insertion direction Y1 of the first vent holes 40*a* (slit holes in this embodiment) in the bottom plates 402 of the photosensitive units 4 that are fitted in the apparatus body 110.

In this embodiment, the resin frame 300 is provided with third air holes 410*c* that let air in from below in the middle portion in the depth direction Y of the apparatus body 110, such that the third air holes 410*c* are opposed to the photosensitive units 4. More specifically, the third air holes 410*c* are provided at positions in the base 331 corresponding to (herein, immediately below) the first vent holes 40*a* in the bottom plates 402 of the photosensitive units 4 that are fitted in the apparatus body 110, and are in the form of a plurality of slit holes extending in the depth direction Y of the apparatus body 110.

As shown in FIG. 13, in this embodiment, the resin frame 300 is provided with photosensitive unit air holes, which are examples of the second air holes 420*a* through which air flows between the second duct 420 and the plurality of photosensitive units 4, such that the photosensitive unit air holes respectively correspond to the plurality of photosensitive units 4. Thus, air W3 in the space P1 can move to the second duct 420 through the second air holes 420*a*.

More specifically, the second air holes 420*a* are provided, above the second duct 420, at positions corresponding to (and overlapping in the length direction of the first vent holes 40*a*) the downstream end portions in the insertion direction Y1 of the first vent holes 40*a* in the bottom plates 402 of the photosensitive units 4 that are fitted in the apparatus body 110.

The resin frame 300 has base portions (see FIG. 8A) that are examples of a plurality of third duct portions 432 respectively constituting at least one portion of the plurality of first unit ducts 430*a*. The third duct portions 432 are provided at positions facing the plurality of development units 2 in the base 331. In a state where the development units 2 are fitted in the resin frame 300, a portion (bottom face 20*a* in this embodiment) of an external face of the case 20 in the development unit 2 that constitutes at least a portion of the first unit duct 430*a* covers the third duct portion 432 with a gap therebetween. It should be noted that at least the portion covering the third duct portion 432 of the case 20 in the development unit 2 may be in form of a recessed line along the insertion direction Y1.

Therefore, in the first unit ducts 430*a*, spaces P2 are formed between the third duct portions 432 in the base 331 and the bottom faces 20*a* of the plurality of development units 2, and in the spaces P2, air is allowed to flow between the front side (the first duct 410 side) of the apparatus body 110 and the rear side (the second duct 420 side) thereof.

In this embodiment, the resin frame 300 is provided with development unit air holes, which are other examples of the first air holes 410*b* through which air flows between the first duct 410 and the plurality of development units 2, such that the development unit air holes respectively correspond to the plurality of development units 2. Thus, the air W1 in the first duct 410 can move to the space P2 through the first air holes 410*b*.

More specifically, the first air holes 410*b* are provided, above the first duct 410, at positions corresponding to (and overlapping in the length direction of the space P2) the upstream end portions in the insertion direction Y1 of the cases 20 of the development units 2 that are fitted in the apparatus body 110.

In this embodiment, the resin frame 300 is provided with development unit air holes, which are other examples of the second air holes 420*b* through which air flows between the second duct 420 and the plurality of development units 2, such that the development unit air holes respectively correspond to the plurality of development units 2. Thus, the air W3 in the space P2 can move to the second duct 420 through the second air holes 420*b*.

More specifically, the second air holes 420*b* are provided, above the second duct 420, at positions corresponding to (overlapping in the length direction of the space P2) the downstream end portions in the insertion direction Y1 of the cases 20 of the development units 2 that are fitted in the apparatus body 110.

In this embodiment, the plurality of photosensitive units 4 and the plurality of development units 2 are arranged side by side along the image forming direction M (herein, the width direction X of the apparatus body 110). The plurality of image forming units 200 include a pre-transfer charging unit 8 (see FIG. 1) provided outside the plurality of photosensitive units 4 and the plurality of development units 2 in the width direction X of the apparatus body 110 (in this embodiment, between the photosensitive unit 4 on the far right side and the transfer roller 10).

Figure 14:
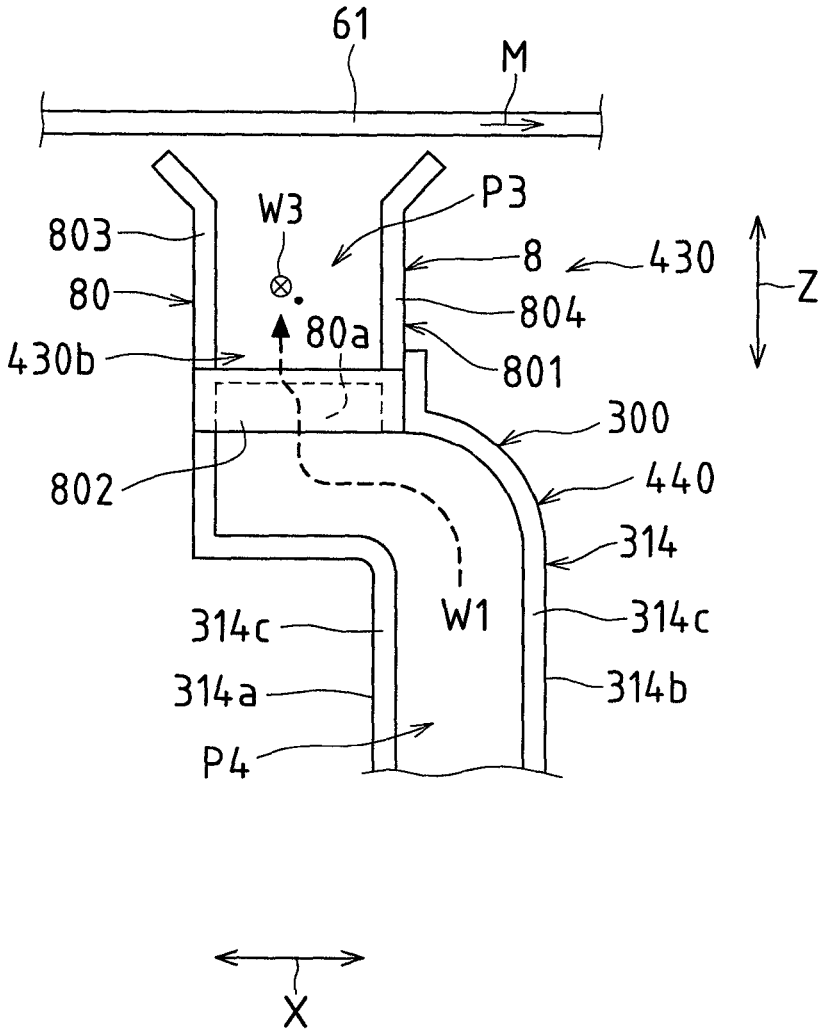
FIG. 14 is a general cross-sectional view schematically showing portions of a pre-transfer charging unit fitted in the resin frame and a flow guide.
Figure 15:
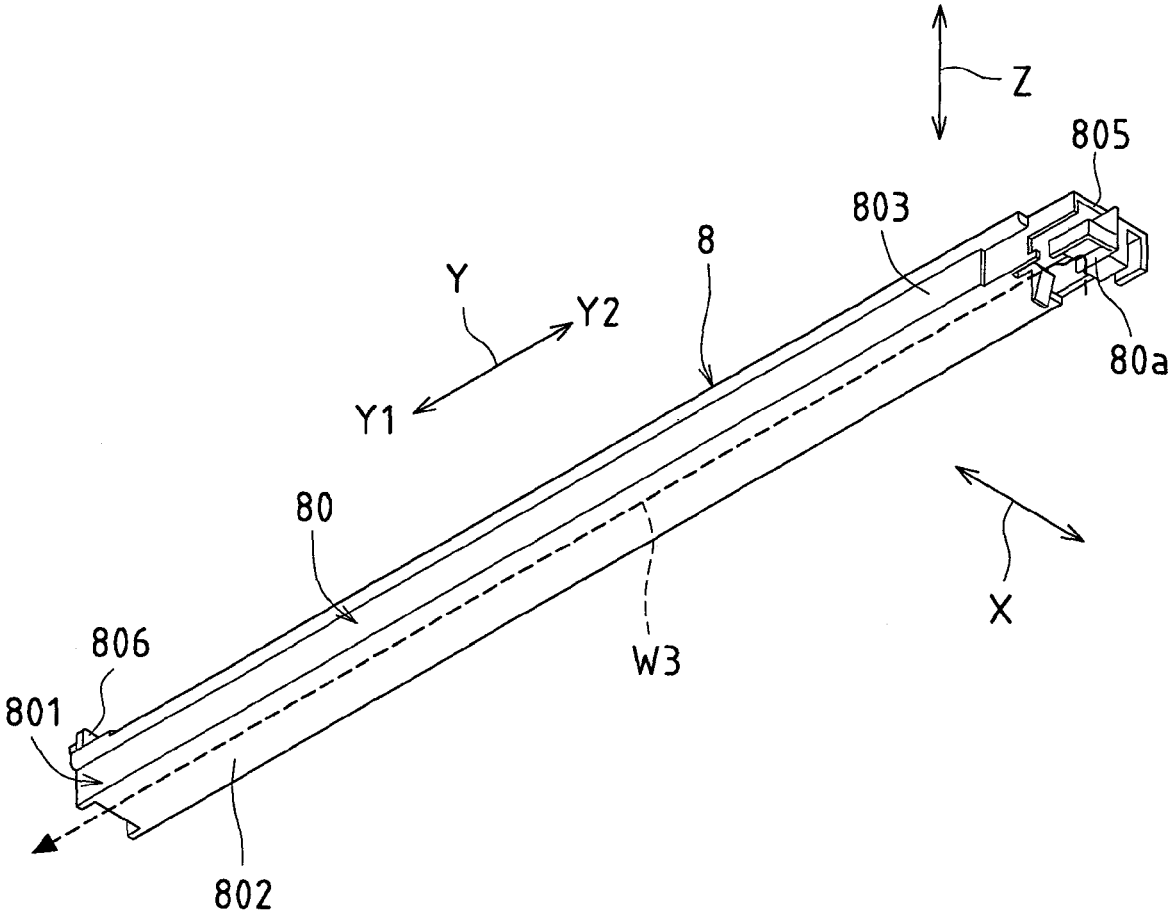
FIG. 15 is a schematic isometric view of the pre-transfer charging unit when viewed diagonally up from the lower front left.
Figure 16:
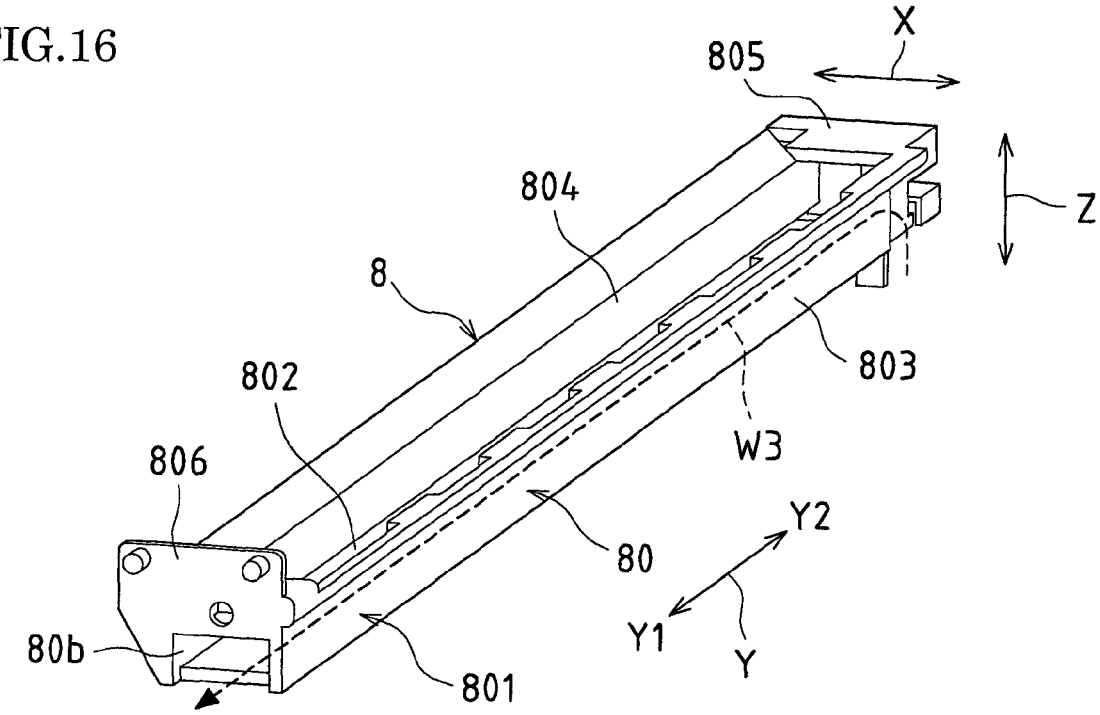
FIG. 16 is a schematic isometric view of the pre-transfer charging unit when viewed diagonally down from the upper back left.
Figure 17:
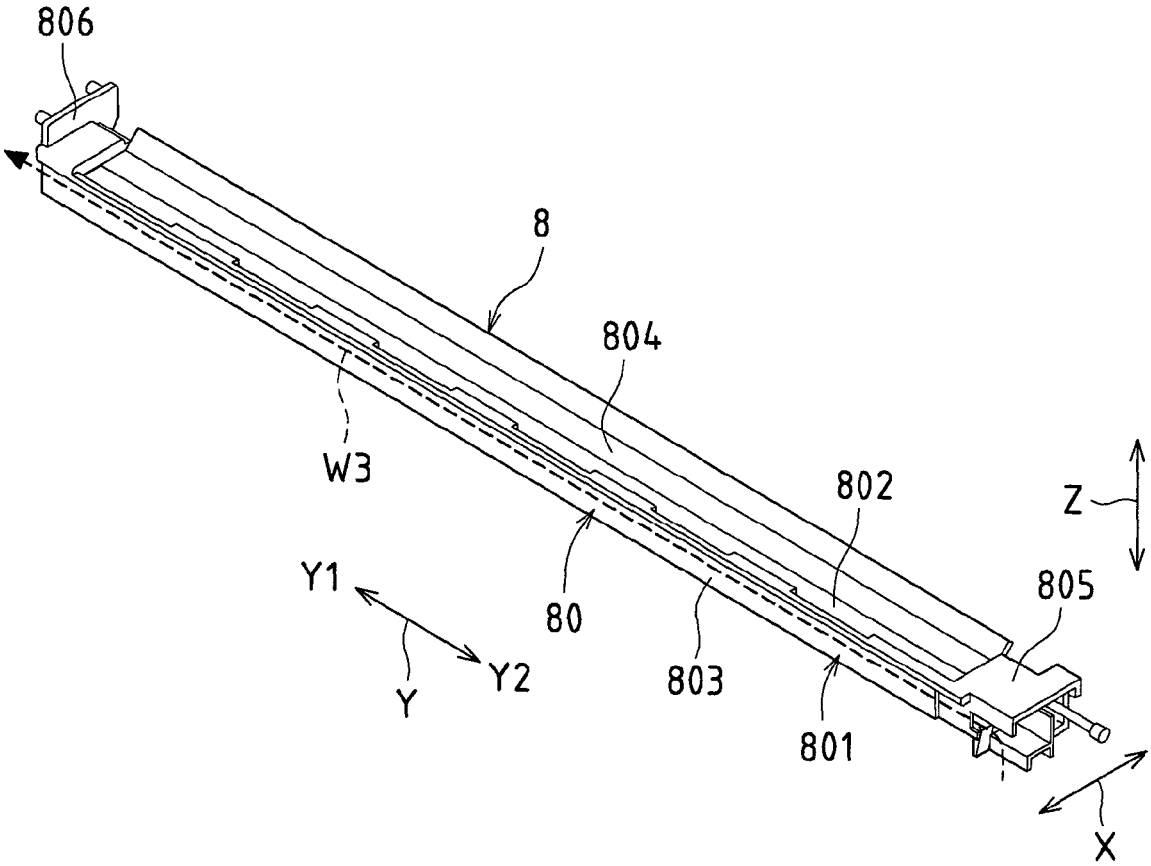
FIG. 17 is a schematic isometric view of the pre-transfer charging unit when viewed diagonally down from the upper front left.
Figure 18:
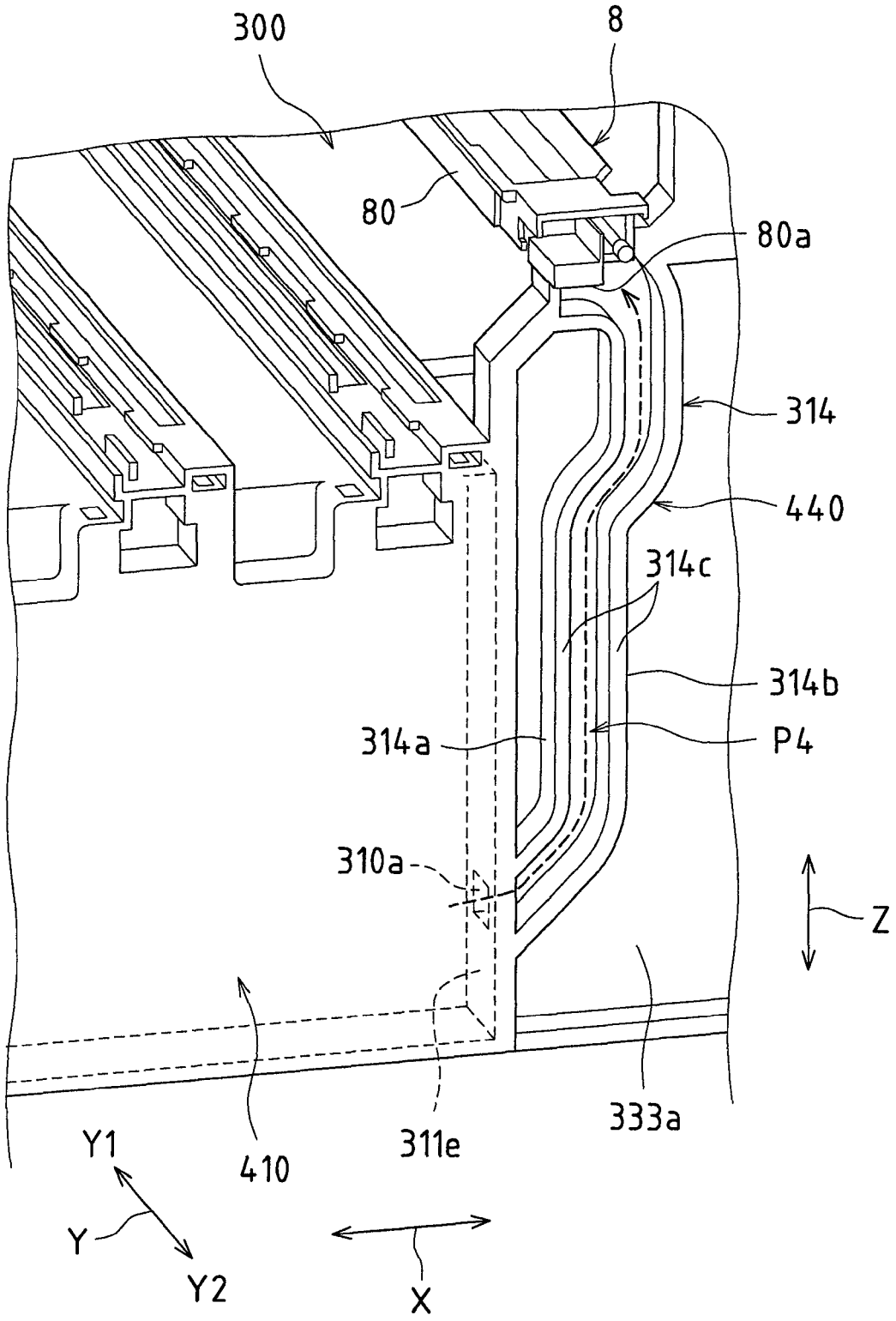
FIG. 18 is a general isometric view showing enlarged portions of the pre-transfer charging unit fitted in the resin frame, the flow guide and the first duct.

FIG. 14 is a general cross-sectional view schematically showing portions of the pre-transfer charging unit 8 fitted in the resin frame 300 and a flow guide 314. FIGS. 15 to 17 are schematic isometric views of the pre-transfer charging unit 8 when viewed diagonally up from the lower front left, diagonally down from the upper back left and diagonally down from the upper front left, respectively. FIG. 18 is a general isometric view showing enlarged portions of the pre-transfer charging unit 8 fitted in the resin frame 300, the flow guide 314 and the first duct 410.

The pre-transfer charging unit 8 serves as a second unit, and as shown in FIGS. 14 to 18, has a shape that is elongated to a direction orthogonal to the first duct 410 (i.e., first side plate portion 333*a*) and the second duct 420 (i.e., second side plate portion 333*b*).

In this embodiment, the third duct 430 extends in the length direction of the pre-transfer charging unit 8, and includes a second unit duct 430*b* that is constituted by a portion of the pre-transfer charging unit 8 (see FIG. 14).

In this embodiment, a portion of a case 80 in the pre-transfer charging unit 8 constitutes at least a portion of the second unit duct 430*b*.

The case 80 in the pre-transfer charging unit 8 that constitutes at least a portion of the second unit duct 430*b* is provided with vent holes (a first vent hole 80*a* (see FIGS. 14 and 15) and a second vent hole 80*b* (see FIG. 16)).

The pre-transfer charging unit 8 is provided with a lower case portion 801, which is one example of the second unit duct 430*b*, in a lower portion of the case 80.

The lower case portion 801 is provided with the first vent hole 80*a* that is open in a portion of the bottom portion (see FIGS. 14 and 15), the second vent hole 80*b* that is open in the downstream side end in the insertion direction Y1 (see FIG. 16). More specifically, the lower case portion 801 has a bottom plate 802, a first side plate 803 (left side), a second side plate 804 (right side), a front member 805 and a rear member 806. The bottom plate 802 extends in the length direction (depth direction Y of the apparatus body), and the first side plate 803 and the second side plate 804 extend perpendicularly upward from the opposite end portion in the short side direction (width direction X of the apparatus body 110) of the bottom plate 802. The bottom plate 802 is provided with the first vent hole 80*a* (in the upstream end portion in the insertion direction Y1 in this embodiment). The rear member 806 is provided with the second vent hole 80*b* that penetrates it in the depth direction Y of the apparatus body 110 (see FIG. 16).

Therefore, in the second unit duct 430*b*, a space P3 is defined by the bottom plate 802, the first side plate 803, the second side plate 804, the front member 805 and the rear member 806, and thus air flows between the first vent hole 80*a* on the front side (first duct 410 side) of the apparatus body 110 and the second vent hole 80*b* on the rear side (second duct 420 side) thereof in the space P3.

Then, as shown in FIG. 18, the resin frame 300 is provided with the flow guide 314 for allowing air to flow between the first duct 410 and the pre-transfer charging unit 8.

More specifically, a third side plate having a third inner side face 311*e* of the first duct 410 is provided with a discharge portion 310*a* that penetrates it in the width direction X of the apparatus body 110. The flow guide 314 is constituted by a pair of flow guides 314*a* and 314*b* that are provided on the front side of the apparatus body 110 on an external face of the first side plate portion 333*a* of the resin frame 300.

The flow guides 314*a* and 314*b* are configured to allow air to flow between the position corresponding to the discharge portion 310*a* in the first duct 410 (position near the discharge portion 310*a*) and the position corresponding to the first vent hole 80*a* in the bottom plate 802 of the pre-transfer charging unit 8 that is fitted in the apparatus body 110 (position near the first vent hole 80*a*). An auxiliary duct 440 for allowing air to flow between the first duct 410 and the pre-transfer charging unit 8 is constituted by the pair of flow guides 314*a* and 314*b* and an unshown blocking member (e.g., sheet-like member such as a seal or film) covering the top portions (end portions) 314*c* of the pair of flow guides 314*a* and 314*b*.

Therefore, in the auxiliary duct 440, a space P4 is defined by the first side plate portion 333*a*, the pair of flow guides 314*a* and 314*b* and the unshown blocking member, and air flows between the discharge portion 310*a* and the first vent hole 80*a* in the space P4.

In this embodiment, the resin frame 300 constitutes a portion of a collecting portion 360 that collects air in a place on the rear side of the apparatus body 110 (see FIG. 6).

Figure 19:
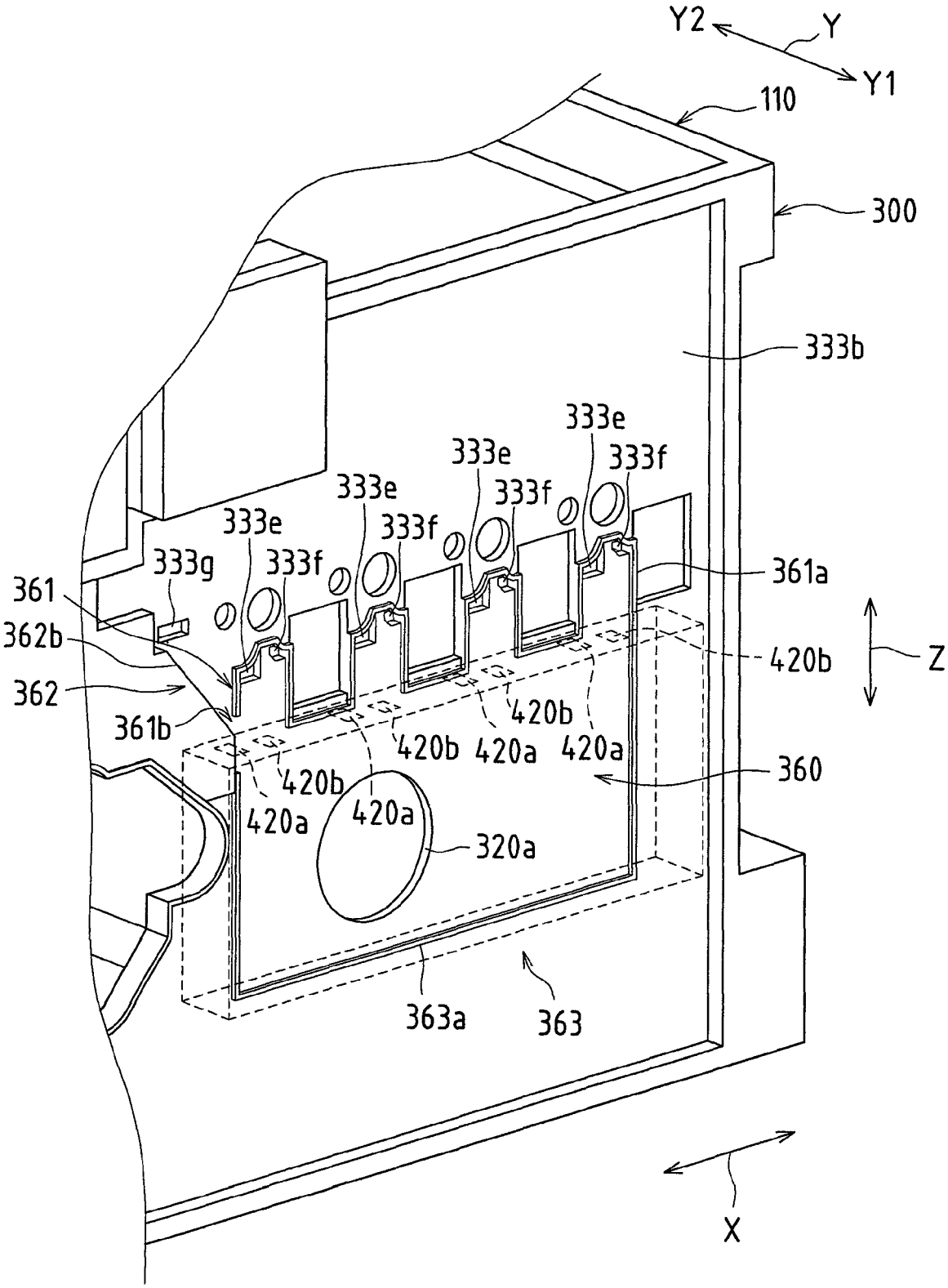
FIG. 19 is a general isometric view of an enlarged portion of a collecting portion in the resin frame shown in FIG. 6.
Figure 20:
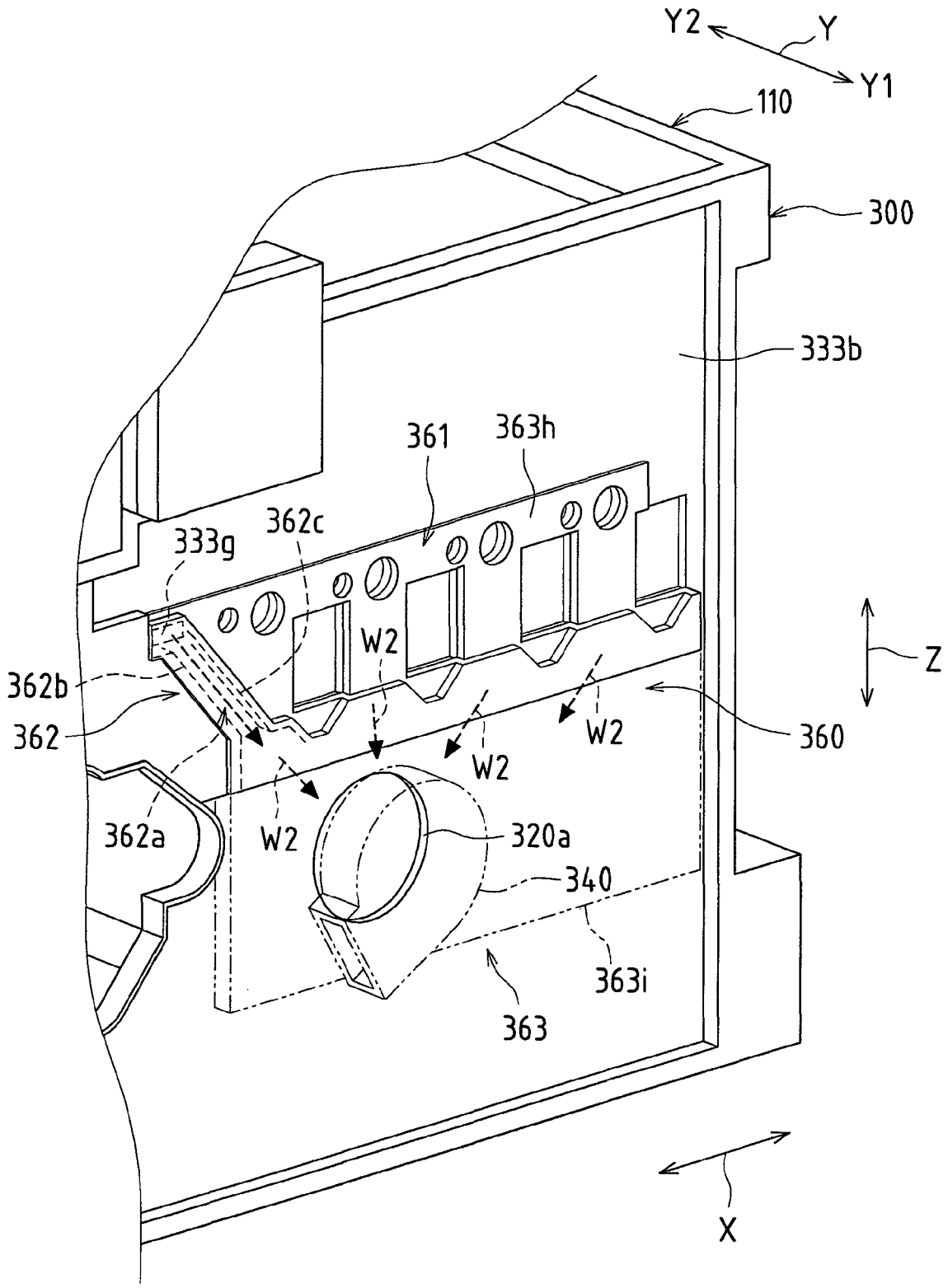
FIG. 20 is a general isometric view showing a state in which a first cover portion is attached to the resin frame shown in FIG. 19.
Figure 21:
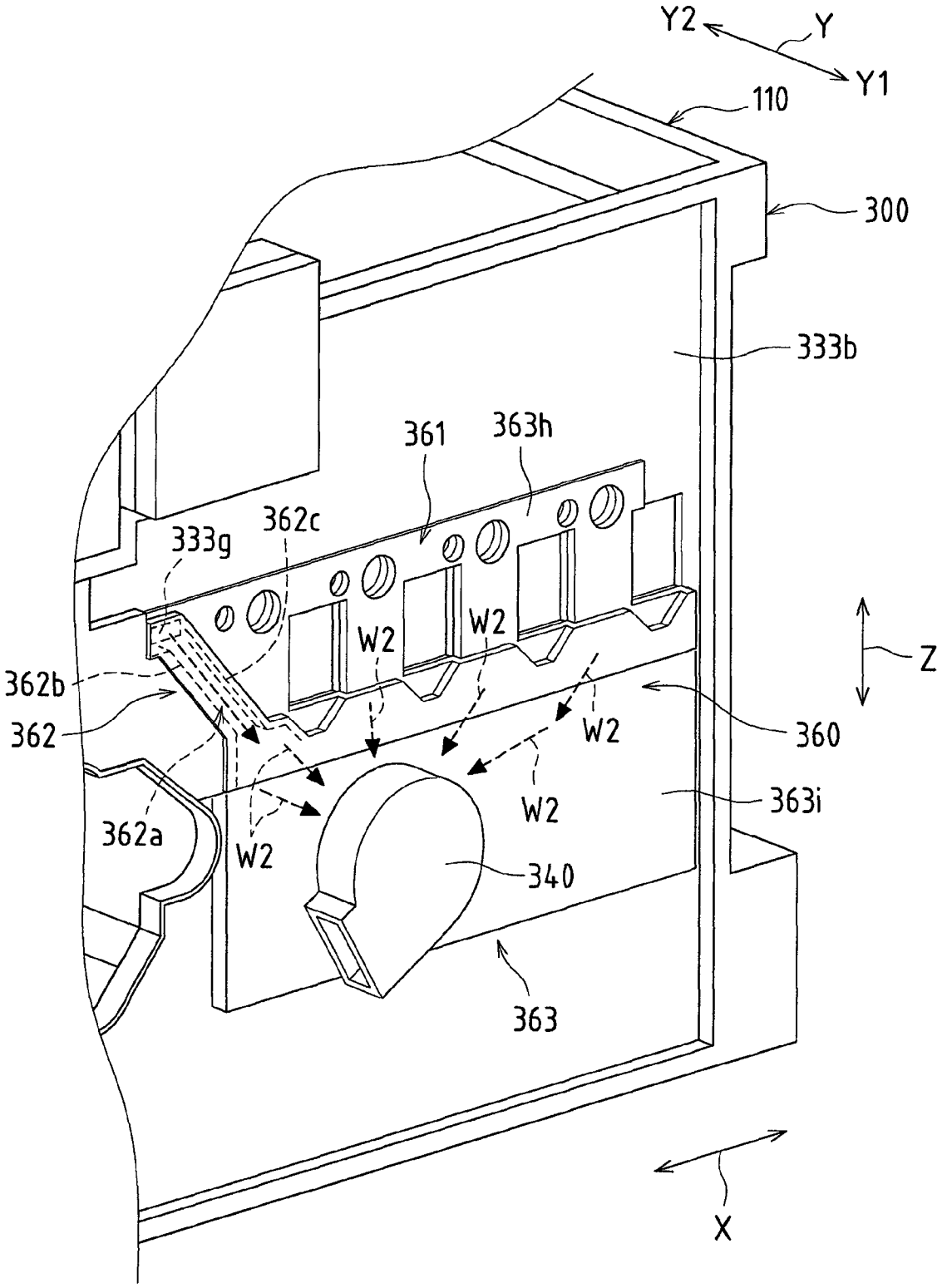
FIG. 21 is a general isometric view showing a state in which a second cover portion is attached to the resin frame shown in FIG. 20 to which the first cover portion is attached.

FIG. 19 is a general enlarged isometric view of an enlarged portion of the collecting portion 360 in the resin frame 300 shown in FIG. 6. FIG. 20 is a general isometric view showing a state in which a first cover portion 363*h* is attached to the resin frame 300 shown in FIG. 19. FIG. 21 is a general isometric view showing a state in which a second cover portion 363*i* is attached to the resin frame 300 shown in FIG. 20 to which the first cover portion 363*h* is attached.

As shown in FIG. 19, in this embodiment, the resin frame 300 is provided with first through-holes 333*e* in a portion of the second side plate portion 333*b* behind the second vent holes 40*b* (see FIG. 10) in the plurality of photosensitive units 4 that are fitted in the apparatus body 110. Also, the resin frame 300 is provided with second through-holes 333*f* in a portion of the second side plate portion 333*b* behind the plurality of development units 2 that are fitted in the apparatus body 110.

Furthermore, the resin frame 300 is provided with a third through-hole 333*g* in a portion of the second side plate portion 333*b* behind the second vent 80*b* (see FIG. 16) in the pre-transfer charging unit 8 that is fitted in the apparatus body 110.

The collecting portion 360 has, as shown in FIGS. 19 to 21, a first collecting portion 361, a second collecting portion 362, and a third collecting portion 363. In this embodiment, an exhaust fan 340 is provided (FIG. 21) that discharges air from the front side of the apparatus body 110 to the rear side of the apparatus body 110 through the first duct 410, the third duct 430, and the second duct 420.

The first collecting portion 361 is configured to guide air coming through the second vent holes 40*b* (see FIG. 10) in the plurality of photosensitive units 4 to the third collecting portion 363 through the first through-holes 333*e*. Also, the first collecting portion 361 is configured to guide air coming from the space P2 (see FIG. 8A) between the third duct portions 432 in the base 331 and the bottom faces 20*a* of the development units 2 to the third collecting portion 363 through the second through-holes 333*f*.

More specifically, the first collecting portion 361 has a first collecting guide portion 361*a* (see FIG. 19) and a first cover portion 363*h* (see FIGS. 20 and 21). The first collecting guide portion 361*a* surrounds the first through-holes 333*e* and second through-holes 333*f* and is connected to a third collecting guide portion 363*a*, as described later, of the third collecting portion 363. The first collecting guide portion 361*a* is provided with an opening portion 361*b* (see FIG. 19) that is in communication with the second collecting portion 362. The first cover portion 363*h* covers the first collecting guide portion 361*a* and also covers a side plate side guide portion 362*b* as described later with a gap therebetween.

The second collecting portion 362 is configured to guide air from the second vent hole 80*b* (see FIG. 16) in the pre-transfer charging unit 8 to the third collecting portion 363 through the third through-hole 333*g*.

More specifically, the second collecting portion 362 has a second collecting guide portion 362*a*. The second collecting guide portion 362*a* is configured to guide air from the third through-hole 333*g* to the opening portion 361*b* of the first collecting portion 361. Specifically, the second collecting guide portion 362*a* includes the side plate side guide portion 362*b* provided in the second side plate portion 333*b* and a cover side guide portion 362*c* (see FIGS. 20 and 21) provided in the first cover portion 363*h* covering the third through-hole 333*g*.

The side plate side guide portion 362*b* is configured to be an inclined portion that is inclined diagonally downward from the third through-hole 333*g* of the second side plate portion 333*b* in this embodiment. The cover side guide portion 362*c* is configured to be an inclined portion that covers the side plate side guide portion 362*b* of the first cover portion 363*h* with a gap therebetween in this embodiment.

The third collecting portion 363 is provided with the exhaust fan 340, and the air from the first collecting portion 361 and second collecting portion 362 is guided to the exhaust fan 340 (see FIG. 21). It should be noted that in this embodiment, as shown in FIGS. 3 and 4, the front side of the apparatus body 110 is provided with an air intake fan 350 that draws air into the first duct 410 from the side face (herein, front lower portion of the fourth side plate portion 333*d* on the left side) of the apparatus body 110. An air intake duct 370 is also provided that guides air from the air intake fan 350 to an air inlet port 311*g* of the first duct portion 311.

More specifically, the third collecting portion 363 has a third collecting guide portion 363*a* (see FIG. 19) and a second cover portion 363*i* (see FIGS. 20 and 21). The third collecting guide portion 363*a* surrounds a discharge port 320*a*, and is connected to the first collecting guide portion 361*a* and the side plate side guide portion 362*b*. The second cover portion 363*i* covers the third collecting guide portion 363*a* and is also connected to the first cover portion 363*h*. It should be noted that in this embodiment, an exhaust duct (not shown) is provided that discharges air from the exhaust fan 340 to the outside.

In the image forming apparatus 100 described above, when the exhaust fan 340 and the air intake fan 350 are driven, the air drawn from the air intake fan 350 moves to the first duct 410 through the air intake duct 370. The air that has moved to the first duct 410 then moves to the second duct 420 through the third duct 430 while being split to the photosensitive units 4 side, the development units 2 side and the pre-transfer charging unit 8 side.

More specifically, on the side of the photosensitive units 4, the air W1 in the first duct 410 moves from the first air holes 410*a* in the base 331 through the first vent holes 40*a* on the front side to the cases 40 (space P1) of the photosensitive units 4. During this period, air is also drawn from below through the first vent holes 40*a*.

The air W3 in the space P is conveyed to the first through-holes 333*e* through the second vent hole 40*b* and then to the first collecting portion 361 and the third collecting portion 363, as well as to the second duct 420 through the first vent holes 40*a* on the rear side and the second air holes 420*a*. The air conveyed to the first collecting portion 361 and the third collecting portion 363 is collected in the first collecting portion 361 and the third collecting portion 363 and then is discharged outside by the exhaust fan 340. The air W2 conveyed to the second duct 420 is discharged outside through the discharge port 320*a* by the exhaust fan 340.

On the side of the development units 2, the air in the first duct 410 moves to the space P2 between the third duct portions 432 and the bottom faces 20*a* of the development units 2 through the first air holes 410*b* in the base 331. Then, the air W3 in the space P2 is conveyed to the first collecting portion 361 and the third collecting portion 363 through the second through-holes 333*f*, as well as to the second duct 420 through the second air holes 420*b*.

The air conveyed to the first collecting portion 361 and third collecting portion 363 is collected in the first collecting portion 361 and the third collecting portion 363 and then is discharged outside by the exhaust fan 340. The air W2 conveyed to the second duct 420 is discharged outside through the discharge port 320*a* by the exhaust fan 340.

On the side of the pre-transfer charging unit 8, the air in the first duct 410 moves to the inside of the case 80 (space P3) of the pre-transfer charging unit 8 through the discharge port 310*a* (see the right lower portion on the first duct 410) and the auxiliary duct 440. The air W3 in the space P3 is conveyed to the second collecting portion 362 and the third collecting portion 363 from the second vent hole 80*b* through the third through-hole 333*g*, and is collected in the second collecting portion 362 and the third collecting portion 363. Then, the air collected in the second collecting portion 362 and the third collecting portion 363 is discharged outside by the exhaust fan 340.

The image forming apparatus 100 of this embodiment is provided with the first duct 410 for allowing air to flow on one side (herein, removable side) of the photosensitive units 4 and the development units 2, the second duct 420 for allowing air to flow on the other side (herein, opposite side of the removable side), and the third duct 430 for allowing air to flow between the first duct 410 and the second duct 420.

Therefore, air can flow not only in the first duct 410 on the removable side, but also in the third duct 430, and furthermore in the second duct 420 on the opposite side to the removable side. For this reason, air can flow reliably to the photosensitive units 4 and the development units 2, and therefore unwanted substances such as ozone or nitrogen oxides (NOx) can be exhausted reliably from the photosensitive units 4 and the development units 2, and the photosensitive units 4 and the development units 2 can be cooled reliably. In addition, the resin frame 300 has the first duct portion 311 constituting at least a portion of the first duct 410, and the second duct portion 321 constituting at least a portion of the second duct 420, and therefore the strength of the resin frame 300 can be improved.

In this embodiment, the first duct 410 allows air to flow on the removable side (user operation side) of the photosensitive units 4 and the development units 2, the second duct 420 allows air to flow on the opposite side to the removable side (user operation side), and the third duct 430 allows air to flow between the first duct 410 and the second duct 420, and therefore unwanted substances such as ozone or nitrogen oxides (NOx) can be exhausted easily to the opposite side to the removable side.

In this embodiment, at least one duct portion of the first duct portion 311 and the second duct portion 321 (herein, both the duct portions 311 and 321) is configured to be a box-like shaped duct portion that is open on one direction, and therefore the strength of the resin frame 300 having the first duct portion 311 and the second duct portion 321 can be improved.

In this embodiment, the strength of the resin frame 300 can be further improved by the reinforcing portion (herein, the top plate having the inner upper face 311*b*, 321*b*, the first side plate having the first inner side face 311*c*, 321*c*, the second side plate having the second inner side face 311*d*, 321*d*, the third side plate having the third inner side face 311*e*, 321*e*, and the fourth side plate having the fourth inner side face 311*f*, 321*f*) that is served by at least one face that constitutes part of at least one of the first duct 410 and the second duct 420 (herein, both the ducts 410 and 420) in the resin frame 300.

In this embodiment, with the first unit ducts 430*a* that are partly constituted by a portion of the photosensitive units 4 and the development units 2, the third duct 430 allows unwanted substances to be exhausted reliably from the photosensitive units 4 and the development units 2, and the photosensitive units 4 and the development units 2 to be cooled reliably.

In this embodiment, the first air holes (410*a*, 410*b*) provided in the resin frame 300 allow air to flow between the first duct 410 and the photosensitive units 4 and the development units 2 reliably.

In this embodiment, the second air holes (420*a*, 420*b*) provided in the resin frame 300 allow air to flow between the second duct 420 and the photosensitive units 4 and the development units 2 reliably.

More specifically, a portion of the case 40 in the photosensitive unit 4 and a portion of the case 20 in the development unit 2 can be used to constitute at least a portion of the first unit duct 430*a*, which can simplify the structure of the first unit duct 430*a*.

Furthermore, the case 40 in the photosensitive unit 4 is provided with vent holes (herein, the first vent holes 40*a* and the second vent hole 40*b*), and therefore air inside the photosensitive unit 4 can flow between the first duct 410 and the second duct 420. This makes it possible to exhaust unwanted substances such as ozone or nitrogen oxides (NOx) inside the photosensitive units 4 and to cool the inside of the photosensitive units 4 reliably.

Furthermore, the case 40 in the photosensitive unit 4 is provided with the air vent holes 40*a*, 40*b*, and therefore a space in the case 40 in the photosensitive unit 4 can be used to constitute at least a portion of the first unit duct 430*a*, which leads to space saving and can simplify the structure of the first unit duct 430*a*.

Furthermore, a gap between a portion of the bottom face 20*a* of the case 20 in the development unit 2 and the third duct portion 432 can be used to constitute at least a portion of the first unit duct 430*a*, which leads to space saving and can simplify the structure of the first unit duct 430*a*.

In this embodiment, air can flow reliably in the pre-transfer charging unit 8 provided outside the photosensitive units 4 and the development units 2 in the width direction X of the apparatus body 110, and therefore unwanted substances such as ozone or nitrogen oxides (NOx) can be exhausted from the pre-transfer charging unit 8, and the pre-transfer charging unit 8 can be cooled reliably.

In this embodiment, the exhaust fan 340 provided on the rear side (herein, the third collecting portion 363) of the apparatus body 110 makes it possible to exhaust forcedly air from the removable side to the opposite side through the first duct 410, the third duct 430 and the second duct 420.

In this embodiment, as color image forming units are taken as an example, a plurality of the photosensitive units 4 and a plurality of the development units 2 are used. However, monochrome image forming units can be taken and a single unit can be used.

The present invention can be embodied and practiced in other different forms without departing from the spirit and essential characteristics thereof. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. An image forming apparatus including a resin frame made of resin and an image forming unit, comprising:

a first duct arranged in a first direction that allows air to flow on one side of the image forming unit, a second duct arranged parallel to the first duct in the first direction that allows air to flow on an other side that is opposite to the one side, and a plurality of third ducts extending in a second direction normal to the first direction that each allows air to flow between the first duct and the second duct, wherein the resin frame has a first duct portion that constitutes at least a portion of the first duct, and a second duct portion that constitutes at least a portion of the second duct, and wherein at least one duct portion of the first duct portion and the second duct portion is a box-shaped duct portion including respective duct openings to the plurality of third ducts, and that includes an opening extending in the first direction, the opening extending in the first direction being an entire face of the box-shaped duct portion.

2. The image forming apparatus according to claim 1, wherein the one side is a removable side of the image forming unit, and the other side is an opposite side to the removable side of the image forming unit.

3. The image forming apparatus according to claim 1, wherein the resin frame has at least one face that constitutes part of at least one duct of the first duct and the second duct, and the at least one face serves also as a reinforcing portion.

4. The image forming apparatus according to claim 1, wherein an exhaust fan is provided that exhausts air from the one side through the first duct, the third duct and the second duct to the other side.

5. The image forming apparatus according to claim 1, wherein the image forming unit includes a color image forming unit.

6. The image forming apparatus according to claim 1, wherein the image forming unit includes a first unit provided between the first duct and the second duct, and the third duct includes a first unit duct that is partly constituted by a portion of the first unit.

7. The image forming apparatus according to claim 6, wherein the resin frame is provided with a first air hole that allows air to flow between the first duct and the first unit.

8. The image forming apparatus according to claim 6, wherein the resin frame is provided with a second air hole that allows air to flow between the second duct and the first unit.

9. The image forming apparatus according to claim 6, wherein the image forming unit includes a plurality of first units arranged side by side along an image forming direction, the image forming unit includes a second unit provided outside the plurality of first units in the image forming direction, the third duct includes a second unit duct that is partly constituted by a portion of the second unit, and the resin frame is provided with an air flow guide that allows air to flow between the first duct and the second unit.

10. The image forming apparatus according to claim 6, wherein a portion of a case in the first unit constitutes at least a portion of the first unit duct.

11. The image forming apparatus according to claim 10, wherein the case in the first unit that constitutes at least a portion of the first unit duct is provided with a vent hole for allowing air to flow between the first duct and the second duct.

12. The image forming apparatus according to claim 10, wherein the resin frame has a third duct portion that constitutes at least a portion of the first unit duct, and an external face of the case in the first unit that constitutes at least a portion of the first unit duct covers the third duct portion.

* * * * *